US007182433B2

(12) United States Patent
Ishizuka et al.

(10) Patent No.: US 7,182,433 B2
(45) Date of Patent: Feb. 27, 2007

(54) POLYMERIZABLE COMPOSITION, INKJET RECORDING HEAD, AND PROCESS FOR PRODUCING INKJET RECORDING HEAD

(75) Inventors: Takahiro Ishizuka, Kanagawa (JP); Tatsuhiko Obayashi, Kanagawa (JP); Eiichi Kato, Kanagawa (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 10/946,258

(22) Filed: Sep. 22, 2004

(65) Prior Publication Data

US 2005/0068368 A1 Mar. 31, 2005

(30) Foreign Application Priority Data

Sep. 29, 2003 (JP) ..... P.2003-337028

(51) Int. Cl.
*B41J 2/14* (2006.01)
*B41J 2/135* (2006.01)

(52) U.S. Cl. ..... 347/47; 347/45; 347/44

(58) Field of Classification Search ..... 347/45, 347/46, 47, 54, 68, 64, 44, 50; 29/1
See application file for complete search history.

(56) References Cited

U.S. PATENT DOCUMENTS 4,499,480 A * 2/1985 Takatori et al. ..... 347/47
2002/0101477 A1* 8/2002 Hiroyuki et al. ..... 347/45

FOREIGN PATENT DOCUMENTS

JP 3021746 1/2000
JP 2001-233972 8/2001

* cited by examiner

*Primary Examiner*—Manish S. Shah
(74) *Attorney, Agent, or Firm*—Buchanan Ingersoll & Rooney PC

(57) ABSTRACT

To provide an inkjet recording head which is excellent in water repellency and wearing resistance and attains high printed-image quality, the inkjet recording head includes a nozzle having: a hole for discharging a recording liquid including an ink; and a portion capable of repelling the ink at the periphery of the hole, wherein the portion contains a crosslinked resin formed from a polymerizable composition having a fluorine-containing polymerizable polymer, and the fluorine-containing polymerizable polymer has: a first structural unit having a fluorine atom; and a second structural unit having a radical-polymerizable group.

8 Claims, 1 Drawing Sheet

POLYMERIZABLE COMPOSITION, INKJET RECORDING HEAD, AND PROCESS FOR PRODUCING INKJET RECORDING HEAD

BACKGROUND OF THE INVENTION

1. Field of the Invention

The present invention relates to an inkjet recording head, an inkjet recorder employing the same, a process for producing the recording head, a fluorine-containing polymerizable polymer, and a polymerizable composition for forming a water-repellent resin film. More particularly, the invention relates to a recording head in which the periphery of ink discharging holes have undergone an ink-repellent treatment and are excellent in water repellency and wearing resistance and with which printed images of excellent quality can be obtained.

2. Background Art

Inkjet recorders in which an ink (or recording liquid) is discharged from discharge holes of a recording head are known as recorders excellent in silence, high-speed recording, etc. The quality of images obtained with a recording head considerably depends on the positional precision of the dots formed from ink droplets on the recording paper. This positional precision of dots is influenced by the direction of flight of ink droplets discharged from discharge holes of the recording head. A technique effective in keeping the direction of flight constant is to regulate the periphery parts of the discharge hole so as to be even and stable during ink droplet ejection. Specifically, it is effective to conduct a treatment for imparting water repellency (ink repellency) to recording head surfaces including the periphery parts of the discharge hole. Furthermore, in the case where a foreign matter such as an ink or paper adheres to the periphery parts of the discharge hole, which have undergone a water-repellent treatment, the foreign matter is removed by scrapping with a cleaning member, e.g., a blade. In this case, the parts which have undergone a water-repellent treatment are required to have resistance to the ink or chemical ingredients contained therein and resistance to the friction caused by a rubbing operation, etc.

A technique for a water-repellent treatment is to treat the periphery parts of discharge hole of a recording head with a fluoroalkylalkoxysilane or the like to impart water repellency thereto (see, for example, JP-A-56-89569). However, this technique has a drawback that for perfectly conduct the treatment, it is necessary to treat the periphery parts of the discharge hole in a manner which may destroy the material constituting the discharging holes. For example, the peripheral parts should be heated at a temperature as high as 150° C. or above for a prolonged time period or heated in a high-pH solution. In addition, the peripheral parts thus treated are still insufficient in resistance to friction in, e.g., a wiping operation.

Another technique for a water-repellent treatment which has been proposed comprises using a fluorine compound having a reactive group in combination with an epoxy resin in order to form through polymerization a film containing the fluorine compound fixed therein and thereby obtain high water repellency even after cleaning operations (see, for example, JP-A-7-148930) However, since the fluorine compound is less apt to dissolve in epoxy resins, it is often difficult to evenly conduct the treatment. In case where the fluoroalkyl chain of the fluorine compound is shortened in order to enhance solubility, the fluoroalkyl chains show impaired migration to the surface, resulting in poor water repellency. Furthermore, use of such a fluorine compound gives a crosslinked film containing an increased amount of the fluoroalkyl chains or having a reduced crosslink density, resulting in a reduced film strength and impaired durability.

There also is a technique in which treatment is conducted with a treating agent comprising a fluorine-containing resin and a blocked isocyanate (see, for example, Japanese Patent No. 3,382,416). High frictional resistance has been reported to be attained by this technique. However, since the blocked isocyanate has poor reactivity, this technique had had a problem that the treatment should be conducted at a high temperature (160° C.) for a prolonged time period and this may destroy the head-constituting material as in the case described above. Consequently, it has been difficult to obtain an increased crosslink density and produce a coating film having excellent performance with satisfactory reproducibility.

Furthermore, there is a technique in which water repellency is imparted by forming a film of a polymer having fluorine-containing polymer chains which have gathered so as to form physical aggregates (see, for example, JP-A-2001-233972). High water repellency has been reported to be attained by this technique. However, it is necessary to increase the amount of a reactive group, such as epoxy or hydroxy, for crosslinking the polymer, and this necessarily results in a hydrophilized cured film. Consequently, it has been difficult to reconcile strength and water repellency.

On the other hand, a resin which comprises a fluorine-containing block copolymer and cures with actinic energy rays has been proposed (see, for example, Japanese Patent No. 3.021,746). The copolymer which has been proposed has excellent water repellency. However, in applications where this copolymer comes into contact with inkjet inks which contain a solvent and a surfactant, have a low surface tension, and are alkaline, the long-term retention of water (ink) repellency and high frictional resistance has been limited.

To sum up, none of the inkjet recording heads according to the related-art techniques which have been proposed so far reconciles wearing resistance and water repellency (ink repellency) to a desired level. There is hence a desire for the development of an inkjet recording head which is excellent not only in water repellency but in long-term wearing resistance and attains high printed-image quality.

SUMMARY OF THE INVENTION

Subjects for the invention are to overcome the above-described problems in related-art techniques and to accomplish the following objects. Namely, an object of the invention is to provide a polymerizable composition from which a water-repellent resin film can be easily formed on an inkjet recording head surface having discharging holes (or ejection orifices) at a temperature of 120° C. or lower. Another object of the invention is to provide an inkjet recording head which is excellent in water repellency and wearing resistance and attains high printed-image quality. Still another object of the invention is to provide a process for producing the recording head.

The present inventors made intensive investigations in order to overcome the problems described above. As a result, it has been found that a molecular structure which has crosslinkable reactive groups arranged at a long distance from each other and is flexible can have improved suitability for crosslinking while retaining intact water repellency, even when the number of the reactive groups is increased to some degree. The invention has been thus completed.

Namely, the invention provides the following, with which the objects described above have been accomplished.

(1) An inkjet recording head, which comprises a nozzle having: a hole for discharging a recording liquid including an ink; and a portion capable of repelling the ink at the periphery of the hole, wherein the portion comprises a crosslinked resin formed from a polymerizable composition comprising a fluorine-containing polymerizable polymer, and the fluorine-containing polymerizable polymer comprises: a first structural unit having a fluorine atom; and a second structural unit having a radical-polymerizable group.

(2) The inkjet recording head according to item (1), wherein the crosslinked resin is formed from the polymerizable composition through a crosslinking reaction, the crosslinking reaction comprising a radical polymerization.

(3) The inkjet recording head according to item (1) or (2), wherein the first structural unit having the fluorine atom is a structural unit represented by one of formulae 1a, 1b, 1c and 1d; and the second structural unit having the radical-polymerizable group is a structural unit represented by formula 2:

1a

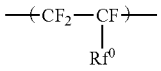

1b

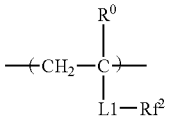

1c

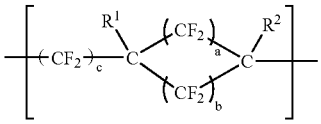

1d

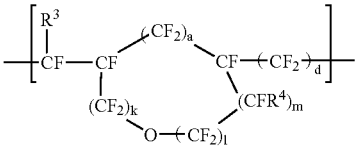

wherein $Rf^0$ represents a fluorine atom, a perfluoroalkyl group having 1 to 8 carbon atoms, or an —$ORf^1$ group, wherein $Rf^1$ represents a fluorine-containing aliphatic group having 1 to 30 constituent carbon atoms, $R^0$ represents a hydrogen atom, a fluorine atom, a methyl group, or a cyano group; L1 represents a covalent bond, —O—, —S—, —CO—, —COO—, —$CONR^{50}$—, —OCO—, —$OCONR^{51}$—, —$NR^{52}CO$—, —$NR^{53}COO$—, —$NR^{54}CONR^{55}$—, —SO—, —$SO_2$—, —$SO_2NR^{56}$—, —$NR^{57}SO_2$—, —$SiR^{58}R^{59}$—, —$PR^{60}$—, —$PO(OR^{61})O$—, —$OPO(OR^{62})$—, —$PO(OR^{63})$ $NR^{64}$—, —$NR^{65}PO(OR^{66})$—, —$NR^{67}PO(NR^{68}R^{69})NR^{70}$—, or —$NR^{71}$—, wherein $R^{50}$ to $R^{71}$ each represents a hydrogen atom, a substituted alkyl group or an unsubstituted alkyl group; and $Rf^2$ represents a hydrocarbon group in which a hydrogen atom is replaced with a fluorine atom in at least one of CH bonds, $R^1$ and $R^2$ are the same or different, and each represents a fluorine atom or a —$C_vF_{2v+1}$ group, wherein v is an integer of 1 to 4; a is 0 or 1; b is an integer of 2 to 5; and c is 0 or 1, $R^3$ and $R^4$ each represents a fluorine atom or a —$CF_3$ group; a is the same as in formula 1c; d is 0 or 1; k is an integer of 0 to 5; l is an integer of 0 to 4; and m is 0 or 1, wherein (k+l+m) is an integer of 1 to 6, Formula 2

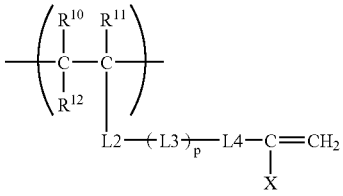

wherein, $R^{10}$ and $R^{11}$ each independently represents a hydrogen atom, a chlorine atom, or a fluorine atom; $R^{12}$ represents a hydrogen atom, a chlorine atom, a fluorine atom, a alkyl group, or a carboxyl group; L3 represents a connecting group having 1 to 20 carbon atoms; L2 and L4 each independently has the same meaning as L1 in formula 1b; p is 0 or 1; and X represents a hydrogen atom, a fluorine atom, a methyl group, or a cyano group.

(4) The inkjet recording head according to any one of items (1) to (3), wherein the fluorine-containing polymerizable comprises: a first segment which is a polymer chain comprising the first structural unit having the fluorine atom; and a second segment which is a polymer chain comprising the second structural unit having the radical-polymerizable group.

(5) The inkjet recording head according to item (4), wherein the fluorine-containing polymerizable polymer is one of: a linear polymer comprising the first segment and the second segment; and a branched polymer comprising the first segment and the second segment.

(6) The inkjet recording head according to any one of items (1) to (5), the nozzle has an underlying surface coated by the polymerizable composition, wherein the underlying surface has a surface irregularity based on JIS B0601-1994 such that:

an arithmetical mean roughness (Ra) is not more than 0.5 μm;

a ratio (Ra/Rz) of the arithmetical mean roughness (Ra) to a ten-point mean roughness (Rz) is 0.1 or more;

a maximum height (Ry) is not more than 0.5 μm; and a mean space of the surface irregularity (Sm) is from 0.005 to 1 μm.

(7) The inkjet recording head according to any one of items (1) to (6), wherein the portion capable of repelling the ink satisfies a condition that after the portion has a saturated charge amount by applying to an electrostatic field, the period that the portion gets to have a half amount of the saturated charge amount is not longer than 60 seconds.

(8) The inkjet recording head according to any one of items (1) to (7), wherein the portion capable of repelling the ink is on an outer surface of the nozzle.

(9) An inkjet recording device, which comprises an inkjet recording head according to items (1) to (8).

(10) A fluorine-containing polymerizable polymer, which comprises:

a first segment which is a polymer chain comprising a first structural unit having a fluorine atom; and a second segment which is a polymer chain comprising a second structural unit having a radical-polymerizable group, wherein the first structural unit having the fluorine atom is represented by one of formulae 3a, 3b, 3c and 3d:

3a

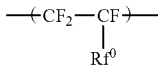

3b

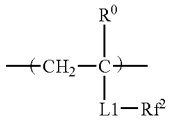

3c

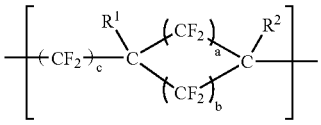

3d

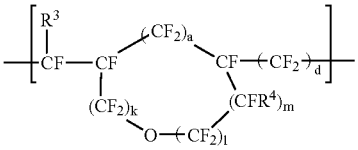

wherein $Rf^0$ represents a fluorine atom, a perfluoroalkyl group having 1 to 8 carbon atoms, or an —$ORf^1$ group, wherein $Rf^1$ represents a fluorine-containing aliphatic group having 1 to 30 constituent carbon atoms, $R^0$ represents a hydrogen atom, a fluorine atom, a methyl group, or a cyano group; L1 represents a covalent bond, —O—, —S—, —CO—, —$CONR^{50}$—, —OCO—, —$OCONR^{51}$—, —$NR^{52}CO$—, —$NR^{53}COO$—, —$NR^{54}CONR^{55}$—, —SO—, —$SO_2$—, —$SO_2NR^{56}$—, —$NR^{57}SO_2$—, —$SiR^{58}R^{59}$—, —$PR^{60}$—, —$PO(OR^{61})O$—, —$OPO(OR^{62})$—, —$PO(OR^{63})NR^{64}$—, —$NR^{65}PO(OR^{66})$——$NR^{67}PO(NR^{68}R^{69})NR^{70}$—, or —$NR^{71}$—, wherein $R^{50}$ to $R^{71}$ each represents a hydrogen atom, a substituted alkyl group or an unsubstituted alkyl group; and $Rf^2$ represents a hydrocarbon group in which a hydrogen atom is replaced with a fluorine atom in at least one of CH bonds, $R^1$ and $R^2$ are the same or different, and each represents a fluorine atom or a —$C_vF_{2v+1}$ group, wherein v is an integer of 1 to 4; a is 0 or 1; b is an integer of 2 to 5; and c is 0 or 1, $R^3$ and $R^4$ each represents a fluorine atom or a —$CF_3$ group; a is the same as in formula 1c; d is 0 or 1; k is an integer of 0 to 5; l is an integer of 0 to 4; and m is 0 or 1, wherein (k+l+m) is an integer of 1 to 6.

(11) The fluorine-containing polymerizable polymer according to item (10), which is one of a linear polymer and a branched polymer.

(12) The fluorine-containing polymerizable polymer according to item (10), which is a linear polymer.

(13) A polymerizable composition, which comprises: a fluorine-containing polymerizable polymer; and a stabilizer for storage, wherein the fluorine-containing polymerizable polymer comprises: a first segment which is a polymer chain comprising a first structural unit having a fluorine atom; and a second segment which is a polymer chain comprising a second structural unit having a radical-polymerizable group.

(14) The polymerizable composition according to item (13), wherein the fluorine-containing polymerizable polymer is one of a linear polymer and a branched polymer.

(15) The polymerizable composition according to item (13), wherein the fluorine-containing polymerizable polymer is a linear polymer.

(16) A process for producing an inkjet recording head which comprises a nozzle having: a hole for discharging a recording liquid including an ink; and a portion capable of repelling the ink at the periphery of the hole, the process comprising:

applying a polymerizable composition, wherein the polymerizable composition comprises: a solvent; and a fluorine-containing polymerizable polymer, and the fluorine-containing polymerizable polymer comprises: a first structural unit having a fluorine atom; and a second unit having a radical-polymerizable group;

vaporizing the solvent to form a film; and irradiating the film with one of an actinic energy ray and a heat to form a crosslinked resin, so as to produce the portion capable of repelling the ink.

The inkjet recording head of the invention is excellent in water repellency and wearing resistance and attains high printed-image quality. Especially when the fluorine-containing polymer to be used is a preferred fluorine-containing polymer specified in the invention, wearing resistance is retained over long.

Furthermore, the polymerizable composition of the invention for forming a water-repellent resin film can easily form a resin film on an inkjet recording head surface having discharge holes at a temperature of 120° C. for lower.

BRIEF DESCRIPTION OF THE DRAWING

The sole FIGURE is an enlarged cross-sectional view showing the main portion of an inkjet recording head of the invention as prepared in the Examples.

DETAILED DESCRIPTION OF THE INVENTION

Figure 1:
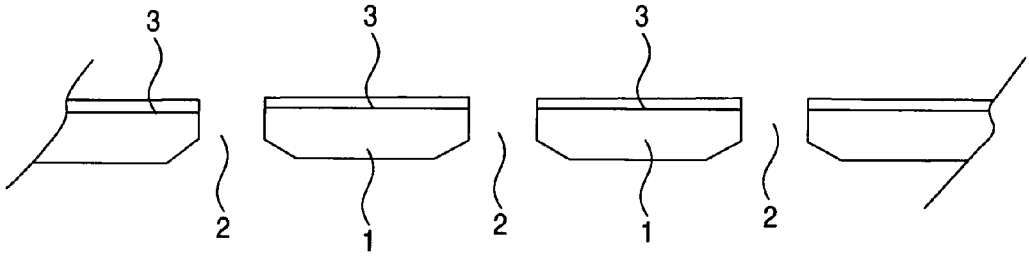

The inkjet recording head of the invention will be explained below.

First, the fluorine-containing polymerizable polymer and the polymerizable composition to be used for producing the inkjet recording head of the invention are explained.

In this specification, ( ) and [ ] in chemical formulae indicate repeating units, and the affixes to such ( ) and [ ] indicate proportions by weight.

(Fluorine-Containing Polymerizable Polymer)

The fluorine-containing polymerizable polymer for use in producing the inkjet recording head of the invention is a polymer comprising a structural unit containing a fluorine atom and a structural unit containing a radical-polymerizable group. The fluorine atom is a component essential to ink repellency, while the radical-polymerizable group is a compound essential for enhancing the strength of the water-repellent resin film and maintaining adhesion to the underlying layer, i.e., the surface of the material constituting the head to be treated. The radical-polymerizable group performs these functions when caused to undergo crosslinking reactions to form covalent bonds within individual molecules of the fluorine-containing polymer or among molecules of the fluorine-containing polymer and with a polymerizable-group-containing material optionally incorporated.

The fluorine-containing polymerizable polymer to be used in the invention preferably is one of the following polymers (I) and (II) from the standpoints of enhancing ink repellency and increasing the durability of the water-repellent resin film obtained through crosslinking reactions.

(I) Polymer which comprises the structural unit containing the fluorine atom and the structural unit containing the radical-polymerizable group and optionally further contains other structural units and in which these structural units are randomly arranged (hereinafter referred to also as fluorine-containing polymerizable polymer (I) of the invention).

(II) Polymer which comprises the structural unit containing the fluorine atom and, arranged separately therefrom, the structural unit containing the radical-polymerizable group, i.e., which comprises a first segment which is a polymer chain comprising the structural unit containing the fluorine atom and a second segment which is a polymer chain comprising the structural unit containing the radical-polymerizable group, and in which the structural unit containing the fluorine atom are represented by any of formulae 1a to 1d given above (hereinafter referred to also as fluorine-containing polymerizable polymer (II) of the invention).

Fluorine-containing polymerizable polymer (II) of the invention preferably is a polymer in which the structural unit containing the fluorine atom are represented by any of formulae 3a to 3d given. Formulae 1a to 1d are the same as formulae 3a to 3d except that the L1 in formula 3b does not include —COO—. Consequently, an explanation on formulae 3a to 3d is omitted.

Fluorine-containing polymerizable polymer (II) of the invention more preferably has a linear or branched structure comprising at least one segment which is the first segment and at least one segment which is the second segment. Even more preferably, the polymer (II) has a linear structure comprising at least one segment which is the first segment and at least one segment which is the second segment, or has a branched structure having the first segment as a branch. Especially preferably, the polymer (II) has a linear structure comprising at least one segment which is the first segment and at least one segment which is the second segment.

The fluorine-containing structural unit contained in the fluorine-containing polymerizable polymer may be of one kind or two or more kinds.

The structural unit containing the fluorine atom may be one in which the atoms constituting the main chain are carbon atoms only or include one or more atoms other than carbon, e.g., oxygen atoms. It is preferred that a fluorine-containing vinyl monomer be introduced in such an amount that the resultant fluorine-containing polymerizable polymer has a fluorine content of 20–60% by weight. The fluorine content in the polymer is more preferably 25–55% by weight, especially preferably 30–50% by weight. By regulating the fluorine content to a value within that range, sufficient water repellency and suitability for crosslinking can be reconciled.

Preferred examples of the structural unit containing the fluorine atom include structural units represented by formulae 1a to 1d given below.

1a

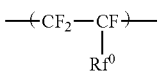

-continued

1b

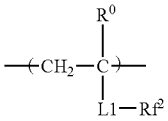

1c

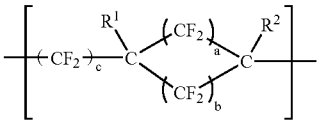

1d

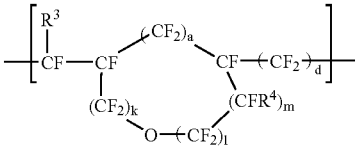

In formula 1a, $Rf^0$ represents a fluorine atom, a perfluoroalkyl group having 1 to 8 carbon atoms, or an —$ORf^1$ group. In the case where $Rf^0$ is a perfluoroalkyl group, more preferred examples thereof include perfluoroalkyl groups having 1 to 4 carbon atoms from the standpoint of the polymerizability of corresponding monomers. Specifically, perfluoromethyl, perfluoroethyl, perfluoropropyl, and perfluorobutyl are more preferred. $Rf^1$ represents a fluorine-containing aliphatic group having 1 to 22 carbon atoms, and preferably is a fluorine-containing aliphatic group having 1 to 12 carbon atoms. Examples thereof include perfluoroalkyl groups having 1 to 8 carbon atoms, —$CH_2F$, —$CHF_2$, —$CH_2CF_3$, —$(CH_2)_2C_2F_5$, —$CH_2CF_2CF_2CFH_2$, —$CH_2(CF_2)_4H$, —$CH_2(CF_2)_8CF_3$, —$CH_2CH_2(CF_2)_4H$, and the like; ones having a branched structure (e.g., $CH(CF_3)_2$, $CH_2CF(CF_3)_2$, $CH(CH_3)CF_2CF_3$, or $CH(CH_3)(CF_2)_5CF_2H$); ones having an alicyclic structure (preferably, a 5- or 6-membered ring, e.g., perfluorocyclohexyl or perfluorocyclopentyl, or an alkyl group substituted with the ring); and groups having a fluorine-containing aliphatic ether bond (e.g., —$CH_2OCH_2CF_2CF_3$, —$CH_2CH_2OCH_2C_4F_8H$, —$CH_2CH_2OCH_2CH_2C_8F_{17}$, —$CH_2CH_2OCF_2CF_2OCF_2CF_2H$, —$CF_2CH_2OCH_2CF_3$, and —$(CF_2)_2(CH_2)_2OCH(CF_3)_3$).

In formula 1b, $R^0$ represents a hydrogen atom, a fluorine atom, methyl, or cyano, and preferably is a hydrogen atom or methyl.

L1 represents a covalent bond, i.e., the state in which the C and $Rf^2$ are directly bonded to each other, —O—, —S—, —CO—, —COO—, —$CONR^{50}$—, —OCO—, —$OCONR^{51}$—, —$NR^{52}CO$—, —$NR^{53}COO$—, —$NR^{54}CONR^{55}$—, —SO—, —$SO_2$—, —$SO_2NR^{56}$—, —$NR^{57}SO_2$—, —$SiR^{58}R^{59}$—, —$PR^{60}$—, —$PO(OR^{61})O$—, —$OPO(OR^{62})$—, —$PO(OR^{63})NR^{64}$—, —$NR^{65}PO(OR^{66})$—, —$NR^{67}PO(NR^{68}R^{69})NR^{70}$—, or —$NR^{71}$—. Preferred of these are —O—, —S—, —CO—, —$CONR^{50}$—, —OCO—, —$OCONR^{51}$—, —$NR^{52}CO$—, —$NR^{53}COO$—, —$NR^{54}CONR^{55}$—, —SO—, —$SO_2$—, —$SO_2NR^{56}$—, —$NR^{57}SO_2$—, $SiR^{58}R^{59}$—, —$PR^{60}$—, —$PO(OR^{61})O$—, —$OPO(OR^{62})$—, —$PO(OR^{63})$ $NR^{64}$—, —$NR^{65}PO(OR^{66})$—, —$NR^{67}PO(NR^{68}R^{69})NR^{70}$—, and —$NR^{71}$—. More preferred are —O—, —S—, —CO—, —OCO—, —$OCONR^{51}$—, —$NR^{52}CO$—, —$NR^{53}COO$—, —$NR^{54}CONR^{55}$—, —SO—, and —$SO_2$—. Even more preferred are —O—, —OCO—, —$OCONR^{51}$—, —$NR^{52}CO$—, and —$NR^{53}COO$—. Especially preferred is —O—. $R^{50}$ to $R^{71}$ each represent a hydrogen atom or a substituted or unsubstituted alkyl group. Preferred of these are a hydrogen atom and substituted or unsubstituted alkyl groups having 1–6 carbon atoms. Especially preferred is a hydrogen atom and unsubstituted alkyl groups having 1–3 carbon atoms.

$Rf^2$ represents a hydrocarbon group in which part or all of the hydrogen atoms in the CH bonds have been replaced with fluorine. This hydrocarbon group may be linear or may have a branched structure or cyclic structure. Furthermore, this hydrocarbon group may have one or more heteroatoms selected from oxygen, nitrogen, and sulfur atoms in a connecting group, or may have one or more substituents selected from hydroxy, alkoxy groups, and the like. Preferred of these are perfluoroalkyl groups having 1 to 20 carbon atoms, 1H,1H-perfluoroalkoxy groups having 2 to 18 carbon atoms, and 1H,1H,2H,2H-perfluoroalkoxy groups having 3 to 18 carbon atoms. More preferred are perfluoroalkyl groups having 3 to 20 carbon atoms, 1H,1H-perfluoroalkoxy groups having 3 to 18 carbon atoms, and 1H,1H,2H,2H-perfluoroalkoxy groups having 4 to 18 carbon atoms. Even more preferred are 1H,1H-perfluoroalkoxy groups having 6 to 18 carbon atoms and 1H,1H,2H,2H-perfluoroalkoxy groups having 6 to 18 carbon atoms. Especially preferred are 1H, 1H, 2H, 2H-perfluoroalkoxy groups having 6 to 18 carbon atoms.

In formula 1c, $R^1$ and $R^2$ may be the same or different and each represent a fluorine atom or a $—C_vF_{2v+1}$ group, wherein v is an integer of 1 to 4. a is 0 or 1, b is an integer of 2 to 5, and c is 0 or 1. When a and/or c is 0, each case indicates a single bond.

In formula 1d, $R^3$ and $R^4$ each represents a fluorine atom or a $—CF_3$ group. a is the same as in formula 1c. d is 0 or 1; k is an integer of 0 to 5; l is an integer of 0 to 4; and m is 0 or 1. When d, k, l, and/or m is 0, each case indicates a single bond. The value of (k+l+m) is an integer in the range of 1 to 6.

Examples of monomers which form the structural unit represented by formula 1a include fluoroolefins (e.g., fluoroethylene, vinylidene fluoride, tetrafluoroethylene, hexafluoroethylene, and hexafluoropropylene), wholly or partly fluorinated mono- or divinyl ethers, and fluorinated cyclic ethers (e.g., hexafluoroepoxypropane, 3-perfluorohexyl-1,2-epoxypropane, and 3-(1H, 1H, 5H-octafluoropentyloxy)-1,2-epoxypropane).

Examples of monomers which form the structural unit represented by formula 1b include partly or wholly fluorinated alkyl ester derivatives of (meth)acrylic acid e.g., Viscoat 6FM (trade name; manufactured by Osaka Organic Chemical) and M-2020 (trade name; manufactured by Daikin Industries)) and wholly or partly fluorinated mono- or divinyl ethers.

Preferred examples of the structural unit represented by formula 1c include (f-1) to (f-8) shown below. Preferred examples of the structural units represented by formula 1d include (f-9) to (f-16) shown below.

(f-1)

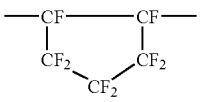

-continued (f-2)

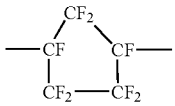

(f-3)

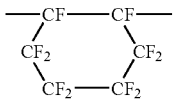

(f-4)

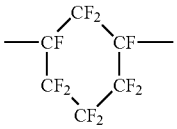

(f-5)

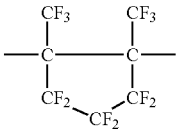

(f-6)

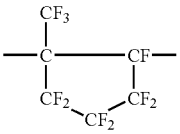

(f-7)

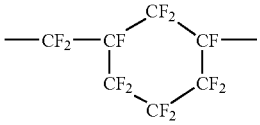

(f-8)

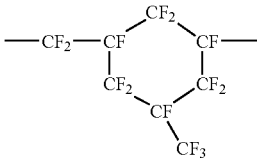

(f-9)

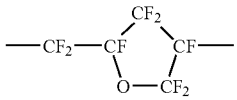

(f-10)

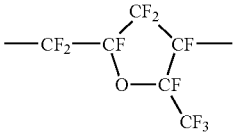

(f-11)

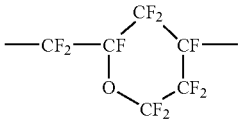

(f-12)

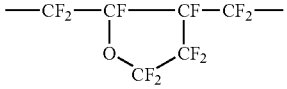

(f-13)

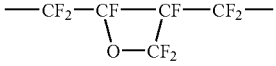

-continued (f-14)

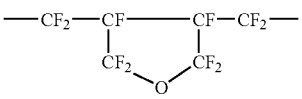

(f-15)

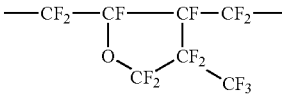

(f-16)

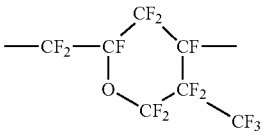

In the case where the atoms constituting the main chain include one or more atoms other than carbon, examples of the main chain comprising the structural unit containing the fluorine atom include a structure made up of structural units bonded to each other through an oxygen atom, as in the following example.

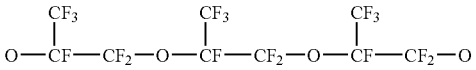

The radical-polymerizable group is a compound which has a polymerizable double bond and solidifies upon application of energy such as ultraviolet, heat, or electron rays or addition of active radicals. Examples of the radical-polymerizable group include acryloyl, methacryloyl, allyl, vinyl (vinyl esters, vinyl ethers, styrene derivatives, etc.), and groups having an internal double bond (maleic acid and the like). Preferred of these are acryloyl, methacryloyl, and vinyl. More preferred are acryloyl and methacryloyl because of their high polymerizability. Especially preferred is acryloyl.

Heightening the proportion of the structural unit containing the radical-polymerizable group improves film strength but tends to result in reduced adhesion to the underlying layer. Because of this, the proportion of the structural unit containing the radical-polymerizable group in the fluorine-containing polymerizable polymer is generally preferably 10–70% by mole, more preferably 20–60% by mole, especially preferably 30–60% by mole, although it varies depending on the kind of the fluorine-containing vinyl monomer units.

Preferred examples of the structural unit containing the radical-polymerizable group include structural units represented by formula 2 given below.

Formula 2

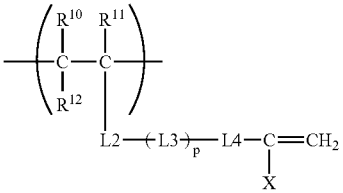

In formula 2, $R^{10}$ and $R^{11}$ each independently represents a hydrogen atom, a chlorine atom, or a fluorine atom. Preferred of these are a hydrogen atom and a fluorine atom. Especially preferred is a hydrogen atom.

$R^{12}$ represents a hydrogen atom, a chlorine atom, a fluorine atom, an alkyl group which may have one or more substituents, or carboxyl. Preferred of these are a hydrogen atom and a fluorine atom. Especially preferred is a hydrogen atom.

L3 represents a connecting group having 1 to 20 carbon atoms. This connecting group may be linear or may have a branched structure or ring structure. Furthermore, this connecting group may have therein one or more heteroatoms selected from oxygen, nitrogen, and sulfur atoms, or may have one or more substituents selected from hydroxy, alkoxy groups, and the like. Preferred of these are alkylene groups having 2 to 8 carbon atoms, alkylene groups containing a cyclic structure therein, phenylene, alkylene groups having an oxygen or nitrogen atom as a connecting group in the alkylene chain, and alkylene groups having one or more substituents selected from hydroxy, alkoxy groups, and the like. More preferred are alkylene groups having 2 to 4 carbon atoms, alkylene groups containing therein a cyclic structure having 6 to 10 carbon atoms, phenylene, alkylene groups having 3 to 10 constituent carbon atoms and having an oxygen or nitrogen atom as a connecting group in the alkylene chain, and alkylene groups having 3 to 10 constituent carbon atoms and having one or more substituents selected from hydroxy, alkoxy groups, and the like. Especially preferred are alkylene groups having 2 to 4 carbon atoms, alkylene groups having 3 to 10 constituent carbon atoms and having an oxygen or nitrogen atom as a connecting group in the alkylene chain, and alkylene groups having 3 to 10 constituent carbon atoms and having one or more substituents selected from hydroxy, alkoxy groups, and the like.

L2 and L4 each independently have the same meaning as L1 in formula 1b given in Ka-1; p is 0 or 1; and X represents a hydrogen atom, a fluorine atom, a methyl group, or a cyano group. From the stand point of appropriate reactivity in curing, X is preferably a hydrogen atom or a methyl group, especially preferably a hydrogen atom.

Examples of the structural units represented by formula 2 are shown below.

R-1

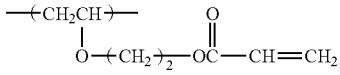

R-2

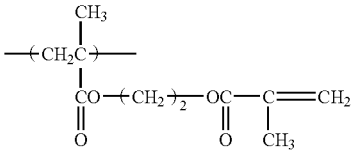

R-3

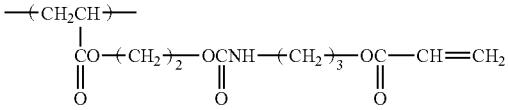

R-4

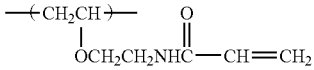

-continued

R-5

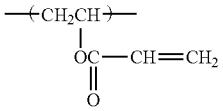

R-6

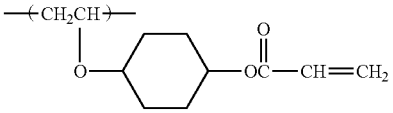

R-7

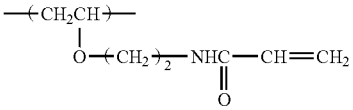

R-8

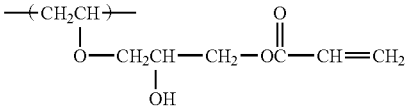

R-9

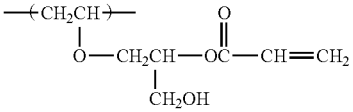

R-10

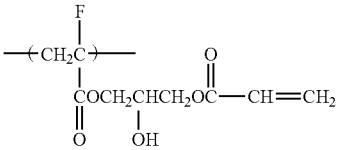

R-11

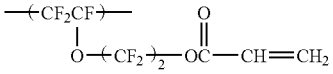

R-12

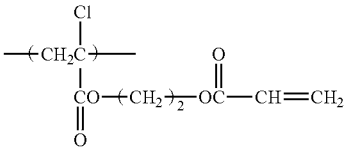

R-13

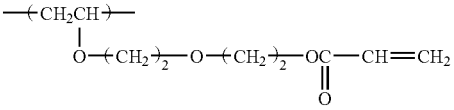

R-14

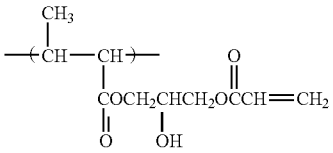

-continued

R-15

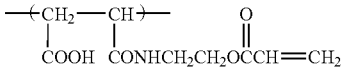

R-16

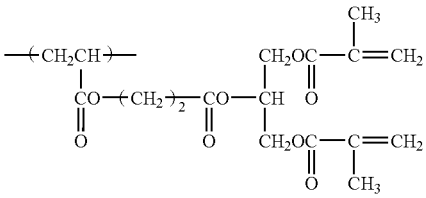

R-17

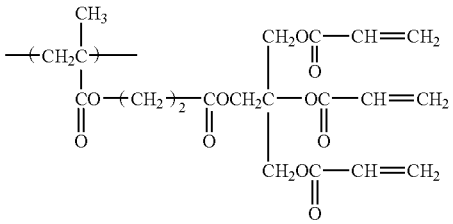

R-18

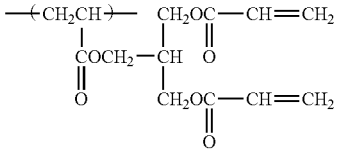

The structural unit containing the radical-polymerizable group may be produced by polymerizing a monomer having a radical-polymerizable group as a side chain. However, in case where the radical-polymerizable group as a side chain reacts during polymerization reaction, this is apt to yield an insoluble gel. It is therefore preferred to produce a copolymer having no radical group in side chains beforehand and then introduce polymerizable groups thereinto.

Methods for introducing radical-polymerizable groups are explained with respect to the introduction of (meth)acryloyl groups as an example. Methods for the introduction are not particularly limited, and examples thereof include: (1) a method in which a polymer having nucleophilic groups, such as hydroxy or amino, is synthesized and (meth)acryloyl chloride, (meth)acrylic anhydride, (meth)acrylic acid/methanesulfonic acid mixed anhydride, or the like is then caused to act on the polymer; (2) a method in which (meth) acrylic acid is caused to act on the polymer having nucleophilic groups in the presence of a catalyst, e.g., sulfuric acid; (3) a method in which a compound having both an isocyanate group and a (meth)acryloyl group, such as, e.g., methacryloyloxypropyl isocyanate, is caused to act on the polymer having nucleophilic groups; (4) a method in which a polymer having epoxy groups is synthesized and (meth)acrylic acid is then caused to act thereon; (5) a method in which a compound having both an epoxy group and a (meth)acryloyl group, such as, e.g., glycidyl methacrylate, is caused to act on a polymer having carboxyl groups; and (6) a method in which a vinyl monomer having a 3-chloropropionic acid ester moiety is polymerized and hydrogen chloride elimination is then conducted.

Especially preferred of those methods in the invention are: a method in which radical-polymerizable groups are introduced into a polymer containing hydroxy groups by method (1), (2), or (3); a method in which radical-polymerizable groups are introduced into a polymer containing glycidyl groups by method (4); and a method in which radical-polymerizable groups are introduced by method (5). More preferred are: a method in which (meth)acryloyl groups are introduced into a polymer containing hydroxy groups by method (1) or (3); a method in which (meth) acryloyl groups are introduced into a polymer containing glycidyl groups by method (4); and a method in which (meth)acryloyl groups are introduced by method (5).

The fluorine-containing polymerizable polymer may suitably contain, besides the structural unit containing the fluorine atom and the structural unit containing the radical-polymerizable group, other structural units (e.g., structural units constituting another segment and a structural unit serving as a segment-connecting unit from various standpoints such as, e.g., adhesion to substrates, regulation of the $T_g$ of the polymer (which contributes to film hardness), and dustproof/antifouling properties.

Monomers usable for constituting such optional structural units are not particularly limited, and any monomers can be used as long as they are copolymerizable with the monomers to be used for constituting the structural unit containing the fluorine atom and the structural unit containing the radical-polymerizable group. Such monomers may optionally contain a functional group.

In the case where the fluorine-containing polymerizable polymer is fluorine-containing polymerizable polymer (II) of the invention (i.e., has a structure capable of being separated into the first segment and the second segment), the first segment may comprise the structural unit containing the fluorine atom and other structural units containing no radical-polymerizable group (hereinafter referred to as "structural unit A"). Although the structural unit A may optionally contain a functional group other than radical-polymerizable groups, they preferably are ones which have no hydrophilic group (e.g., hydroxy or carboxyl) from the standpoint of not impairing water repellency.

Furthermore, the second segment may comprise the structural unit containing the radical-polymerizable group and other structural units containing no radical-polymerizable group (hereinafter referred to as "structural unit B"). Any monomers can be used for constituting the structural unit B as long as they are copolymerizable with the starting material monomer to be used for constituting the structural unit containing the radical-polymerizable group or with the starting material monomer to be used for constituting structural units into which a radical-polymerizable group is to be introduced. Although the structural unit B may optionally contain a functional group other than radical-polymerizable groups, they preferably are ones which contain a functional group capable of improving adhesion to substrates or reacting with an additive undergoing a curing reaction.

Examples of monomers usable for constituting the optional structural units described above are as follows. Examples of the monomers having no functional group include olefins (e.g., ethylene, propylene, isoprene, vinyl chloride, and vinylidene chloride), acrylic esters (e.g., methylacrylate, ethyl acrylate, 2-ethylhexyl acrylate, and acrylates having a polydimethyl siloxane structure in the ester part), methacrylic esters (e.g., methyl methacrylate, ethyl methacrylate, allyl methacrylate, and methacrylates having a polydimethylsiloxane structure in the ester part), styrene derivatives (e.g., styrene and p-methoxystyrene), vinyl ethers (e.g., methyl vinyl ether, ethyl vinyl ether, and cyclohexyl vinyl ether), vinyl esters (e.g., vinyl acetate, vinyl propionate, and vinyl cinnamate), acrylamide compounds (e.g., N,N-dimethylacrylamide, N-tert-butylacrylamide, and N-cyclohexylacrylamide), methacrylamide compounds (e.g., N,N-dimethylmethacrylamide), and acrylonitrile. Especially preferred of these are olefins, acrylic esters (acrylates in which the ester group has 4 or more carbon atoms and acrylates having a polydimethylsiloxane structure in the ester part), methacrylic esters (methacrylates in which the ester group has 4 or more carbon atoms and methacrylates having a polydimethylsiloxane structure in the ester part), styrene derivatives, and vinyl ethers.

Examples of the monomers containing a functional group include epoxy-containing vinyl monomers (e.g., glycidyl acrylate, methacrylates containing 1,2-epoxycyclohexyl, and glycidyl vinyl ether), hydroxy-containing vinyl monomers (e.g., 2-hydroxyethyl methacrylate, 2,3-dihydroxypropyl acrylate, N-hydroxyacrylamide, p-hydroxymethylstyrene, hydroxyethyl vinyl ether, and hydroxybutyl vinyl ether), vinyl monomers containing a silane coupling group (e.g., 3-trimethoxysilylpropyl acrylate and 3-triethoxysilylpropyl methacrylate), amino-containing vinyl monomers (e.g., 3-dimethylaminopropyl acrylate and 3-aminopropylacrylamide), and carboxyl-containing vinyl monomers (e.g., acrylic acid, crotonic acid, maleic acid, and itaconic acid).

Monomers for constituting the optional structural units may be used in combination of two or more thereof according to purposes. In the case where the optional structural units are used, the proportion of all the optional structural units introduced in the fluorine-containing polymerizable polymer is preferably 65% by mole or smaller, more preferably 40% by mole or smaller, especially preferably 30% by mole or smaller.

The fluorine-containing polymerizable polymer (including each fluorine-containing polymerizable polymer of the invention) preferably has a number-average molecular weight of 1,500 to 500,000 and a degree of polymerization of 10 to 1,000. More preferably, the average molecular weight and degree of polymerization thereof are 1,500 to 200,000 and 10 to 500, respectively. Especially preferably, the average molecular weight and degree of polymerization thereof are 1,500 to 100,000 and 10 to 200, respectively.

Examples of fluorine-containing polymerizable polymer (I) of the invention are shown below. As stated above, these examples of fluorine-containing polymerizable polymer (I) of the invention each are a polymer having a structure incapable of being separated into the first segment and the second segment. Examples of fluorine-containing polymerizable polymer (II) of the invention are successively shown below. As stated above, these examples of fluorine-containing polymerizable polymer (II) each are a polymer capable of being separated into the first segment and second segment described above.

Fluorine-Containing Polymerizable Polymer (I) of the Invention

Polymers of structure incapable of being separated into first segment and second segment

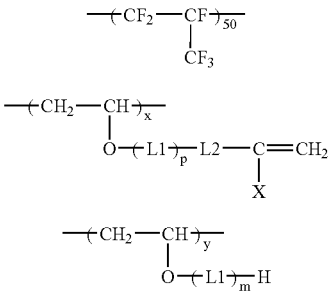
| | x | y | P | L1 | L2 | X |
|---|---|---|---|---|---|---|
| P-1 | 50 | 0 | 1 | $—CH_2CH_2—$ | —OC(=O)— | H |
| P-2 | 50 | 0 | 1 | $—CH_2CH_2—$ | —OC(=O)— | $CH_3$ |
| P-3 | 45 | 5 | 1 | $—CH_2CH_2—$ | —OC(=O)— | H |
| P-4 | 40 | 10 | 1 | $—CH_2CH_2—$ | —OC(=O)— | H |
| P-5 | 30 | 20 | 1 | $—CH_2CH_2—$ | —OC(=O)— | H |
| P-6 | 20 | 30 | 1 | $—CH_2CH_2—$ | —OC(=O)— | H |
| P-7 | 50 | 0 | 0 | — | —C(=O)— | H |
| P-8 | 50 | 0 | 1 | $—C_4H_8—$ | —O— | H |
| P-9 | 50 | 0 | 1 | $—(CH_2)_2O(CH_2)_2—$ | —OC(=O)— | H |
| P-10 | 50 | 0 | 1 | 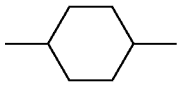 | —OC(=O)— | H |
| P-11 | 50 | 0 | 1 | $—CH_2CH_2—$ | —NHC(=O)— | H |
| P-12 | 50 | 0 | 1 | $—CH_2CH_2OC(=O)NHCH_2CH_2—$ | —OC(=O)— | H |
| P-13 | 50 | 0 | 1 | $—CH_2CH_2OC(=O)NHCH_2CH_2CH_2—$ | —OC(=O)— | $CH_3$ |
| P-14 | 50 | 0 | 1 | $—CH_2CH_2CH_2CH_2OC(=O)NHCH_2CH_2CH_2—$ | —OC(=O)— | $CH_3$ |
| P-15 | 50 | 0 | 1 | $—CH_2CH(OH)CH_2—$ | —OC(=O)— | H |

-continued

| | | | | | | |
|---|---|---|---|---|---|---|
| P-16 | 50 | 0 | 1 | $-CH_2CH(CH_2OH)-$ | $-OC(=O)-$ | H |
| P-17 | 50 | 0 | 1 | $-CH_2CH_2OCH_2-CH(OH)CH_2-$ | $-OC(=O)-$ | H |
| P-18 | 50 | 0 | 1 | $-CH_2OCH_2CH(OH)-CH_2-$ | $-OC(=O)-$ | $CH_3$ |
| P-19 | 50 | 0 | 1 | $-CH_2OCH_2CH(CH_2OH)-$ | $-OC(=O)-$ | $CH_3$ |
| P-20 | 40 | 10 | 1 | $-CH_2CH_2-$ | $-OC(=O)-$ | $CH_3$ |

$$-(CF_2-CF(CF_3))_a-$$

$$-(CH_2-CH(O-L1-OC(=O)CH=CH_2))_b-$$

$$-(A)_c-$$

| | a | b | c | L1 | A |
|---|---|---|---|---|---|
| P-21 | 55 | 45 | 0 | $-CH_2CH_2-$ | — |
| P-22 | 45 | 55 | 0 | $-CH_2CH_2-$ | — |
| P-23 | 50 | 45 | 5 | $-CH_2CH_2OC(=O)NHCH_2CH_2CH_2-$ | $-CH_2-CH(OCH_2CH_2OH)-$ |
| P-24 | 50 | 45 | 5 | $-CH_2CH(OH)-CH_2-$ | $-CH_2-CH(O-CH_2-\text{epoxide})-$ |
| P-25 | 50 | 45 | 5 | $-CH_2CH(CH_2OH)-$ | $-CH_2-CH(O-CH_2-\text{epoxide})-$ |
| P-26 | 50 | 40 | 10 | $-CH_2CH_2-$ | $-CH_2-CH(OCH_2CH_3)-$ |
| P-27 | 50 | 40 | 10 | $-CH_2CH_2-$ | $-CH_2-CH(O-\text{cyclohexyl})-$ |
| P-28 | 50 | 40 | 10 | $-CH_2CH_2-$ | $-CH(CH_3)-CH(COOH)-$ |

-continued
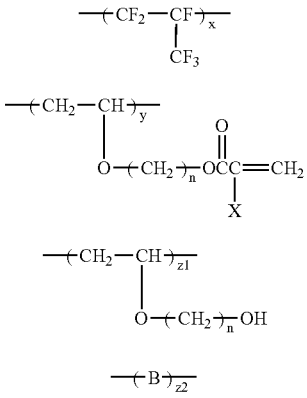
| | x | y | z1 | Z2 | n | X | B |
|---|---|---|---|---|---|---|---|
| P-29 | 50 | 40 | 5 | 5 | 2 | H | $-CH_2-CH(O-CH_2CH_3)-$ |
| P-30 | 50 | 35 | 5 | 10 | 2 | H | $-CH_2-CH(O-C(CH_3)_3)-$ |
| P-31 | 40 | 40 | 10 | 10 | 4 | $CH_3$ | $-CH_2-CH(O-C_6H_{11})-$ |
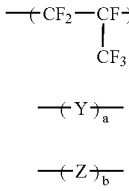
| | a | b | Y | Z |
|---|---|---|---|---|
| P-32 | 45 | 5 | $-CH(CH_3)-CH(CO_2CH_2CH(OH)CH_2OC(=O)C(CH_3)=CH_2)-$ | $-CH(CH_3)-CH(COOH)-$ |
| P-33 | 40 | 10 | $-CH_2-CH(CO_2H)-$ $-CH(CONHCH_2CH_2OC(=O)CH=CH_2)-$ | $-HC-CH-$ (succinic anhydride ring) |
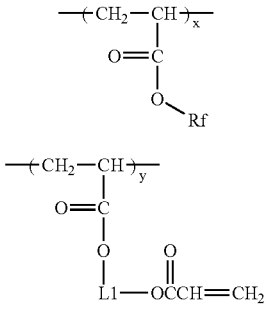

-continued
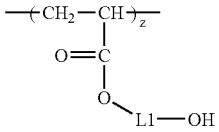
| | x | y | z | Rf | L1 |
|---|---|---|---|---|---|
| P-34 | 55 | 45 | 0 | $—CH_2CH_2C_8F_{17}$-n | $—CH_2CH_2—$ |
| P-35 | 60 | 30 | 10 | $—CH_2CH_2C_4F_8H$-n | $—CH_2CH_2—$ |
| P-36 | 40 | 60 | 0 | $—CH_2CH_2C_6F_{12}H$ | $—CH_2CH_2CH_2CH_2—$ |
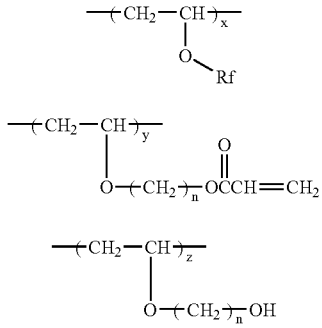
| | x | y | z | n | Rf |
|---|---|---|---|---|---|
| P-37 | 50 | 50 | 0 | 2 | $—CH_2C_4F_8H$-n |
| P-38 | 40 | 55 | 5 | 2 | $—CH_2C_4F_8H$-n |
| P-39 | 30 | 70 | 0 | 4 | $—CH_2C_8F_{17}$-n |
| P-40 | 60 | 40 | 0 | 2 | $—CH_2CH_2C_8F_{17}H$-n |
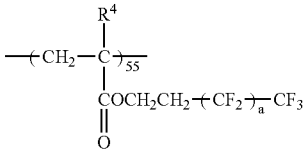
"a" is a mixture of 5, 7, and 9.
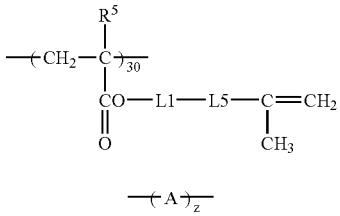
| | $R^4$ | $R^5$ | L1 | L5 | $—(A)_z—$ |
|---|---|---|---|---|---|
| P-41 | H | $CH_3$ | 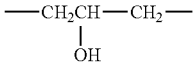 | 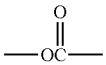 | 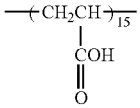 |
| P-42 | H | H | 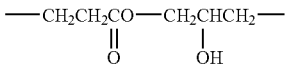 | 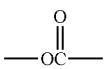 | 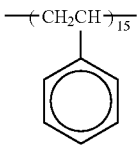 |

-continued
| | | | | | |
|---|---|---|---|---|---|
| P-43 | H | H | $-CH_2CH-CH_2-$ <br> $OC-CH=CH_2$ <br> O | O <br> $-OC-$ | $-(CH_2CH)_3-$ <br> CO, O, OH, OH <br> $-(CH_2CH)_{12}-$ <br> 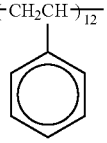 |
| P-44 | $CH_3$ | $CH_3$ | $-CH_2CH_2OCNH-CH_2CH_2-$ <br> O | O <br> $-OC-$ | $-(CH_2CH)-$ <br> CO, O <br> 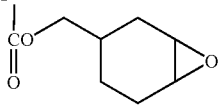 |
| P-45 | F | H | — | O <br> $-C-$ | $CH_3$ <br> $-(CH_2C)-$ <br> $CO-CH_2-CH=CH_3$ <br> O |
| P-46 | H | H | $-CH_2CH_2-$ | O <br> $-OC-$ | $CH_3$ <br> $-(CH_2C)-$ <br> $CO-(CH_2)_3-(SiO)_{11}-Si-CH_3$ <br> O, $CH_3$, $CH_3$, $CH_3$, $CH_3$ |
| P-47 | H | H | $-CH_2CH_2OCNHCH_2CH_2-$ <br> O | O <br> $-OC-$ | $-(CH_2CH)-$ <br> $CO-(CH_2)_3-Si-OCH_3$ <br> O, $OCH_3$, $OCH_3$ |
| P-48 | 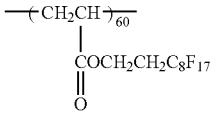 | 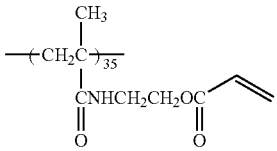 | 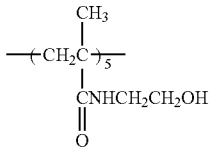 | | |
| P-49 | 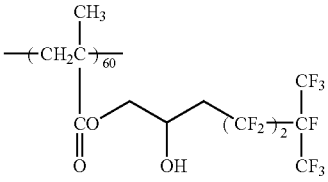 | 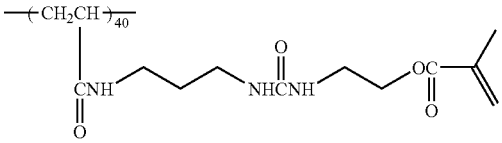 | | | |
| P-50 | 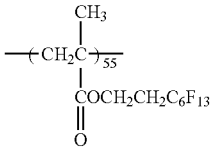 | 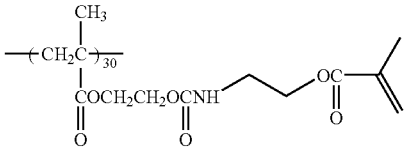 | 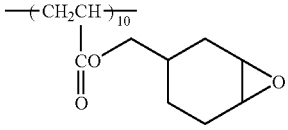 <br> 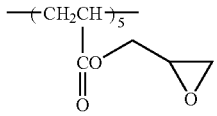 | | |

-continued
P-51
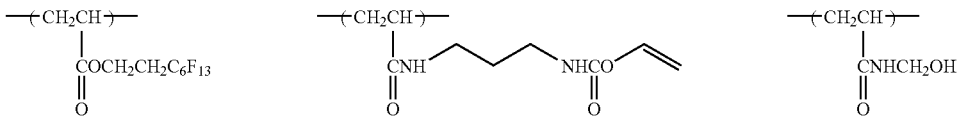
Fluorine-Containing Polymerizable Polymer (II) of the Invention
Polymers comprising separate segments, i.e., first segment and second segment
(1) and (2) indicate the first segment and the second segment, respectively.
b indicates that the polymer is a block copolymer having a covalent bond for segment linkage.
P-60
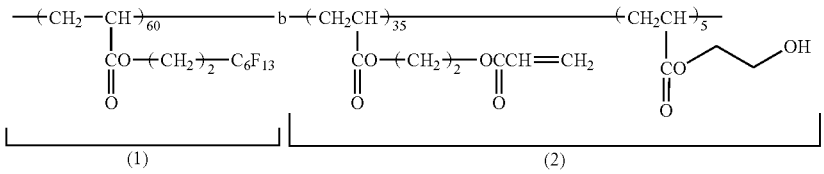
P-61
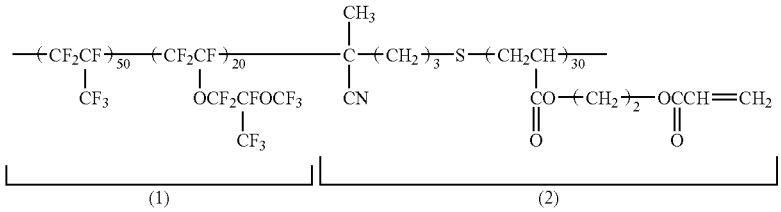
P-62
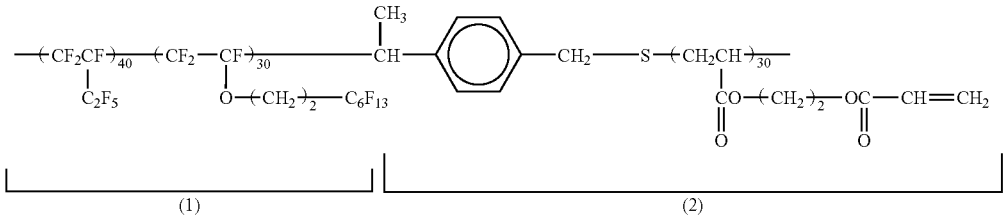
P-63
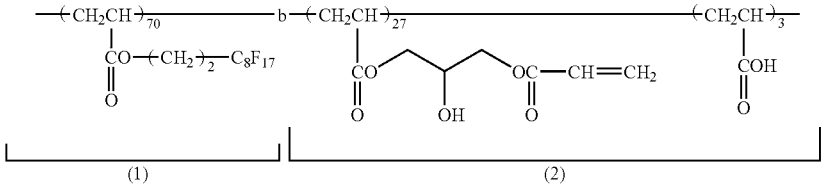
P-64
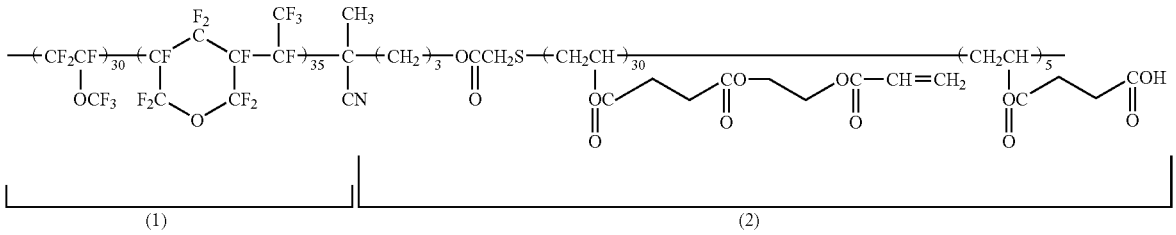

-continued
P-65
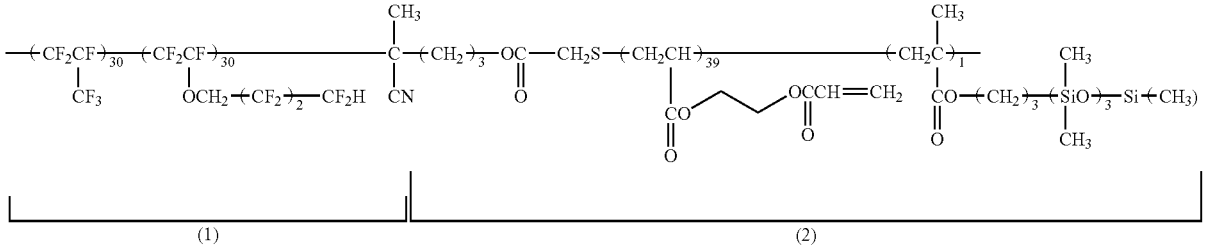
P-66
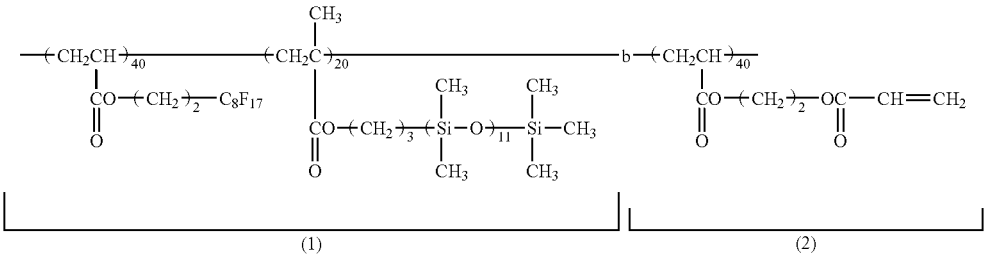
P-67
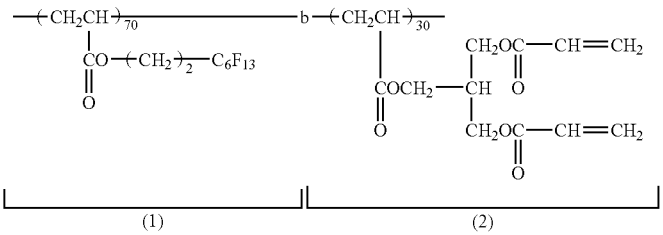
P-68
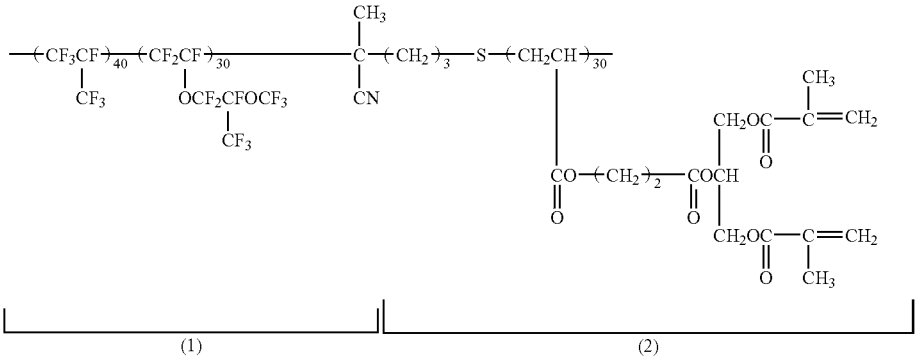
P-69
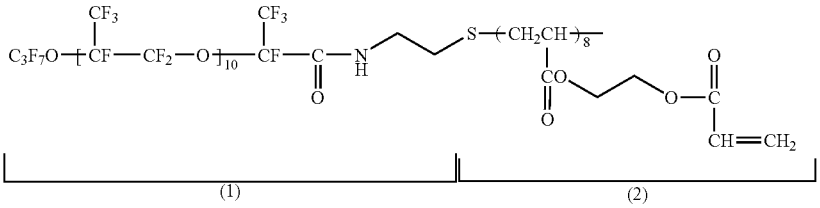

(Polymers Having Branched Structure)

P-70

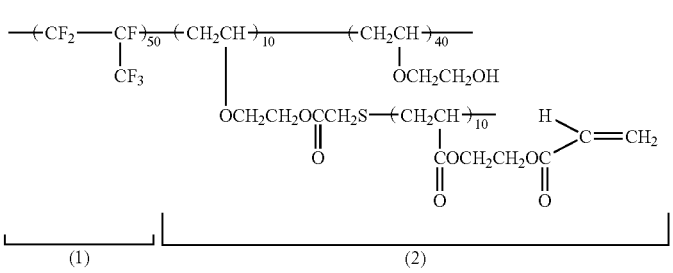

P-71

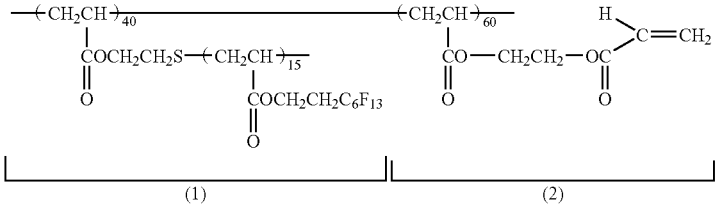

P-72

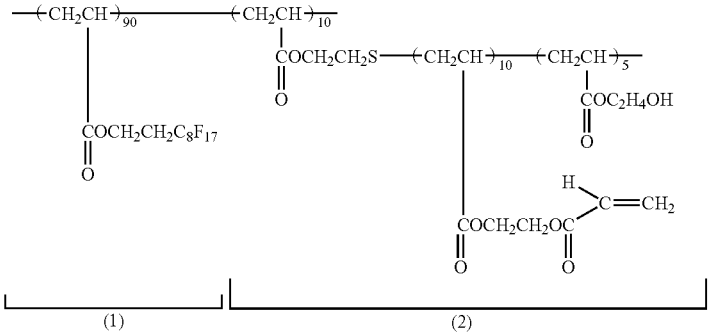

The fluorine-containing polymerizable polymer to be used in the invention (including fluorine-containing polymerizable polymer (I) or (II) of the invention) can be synthesized by synthesizing a precursor, e.g., a hydroxy-containing polymer, by any of various polymerization techniques, e.g., solution polymerization, precipitation polymerization, suspension polymerization, bulk polymerization, or emulsion polymerization, and then introducing (meth)acryloyl or other groups into the precursor by any of the polymer reactions described above. The polymerization reaction can be conducted by a known operation such as, e.g., a batch process, semi-continuous process, or continuous process.

Examples of methods for initiating the polymerization include a method in which a radical initiator is used and a method in which the reaction system is irradiated with light or a radiation. The polymerization techniques and methods for polymerization initiation are described in, e.g., Sadatsugu Tsuruta, Kôbunshi Gôsei Hôhô, revised edition (The Nikkan Kogyo Shinbun, Ltd., 1971) and Takayuki Otsu and Masayoshi Kinoshita, Kôbunshi Gôsei No Jikken-hô, Kagaku Dozin Co., Ltd., published in 1972, pp. 124–154.

Especially preferred of those polymerization techniques is the solution polymerization method in which a radical initiator is used. Examples of solvents usable in the solution polymerization method include various organic solvents such as ethyl acetate, butyl acetate, acetone, methyl ethyl ketone, methyl isobutyl ketone, cyclohexanone, tetrahydrofuran, dioxane, N,N-dimethylformamide, N,N-dimethylacetamide, benzene, toluene, acetonitrile, methylene chloride, chloroform, dichloroethane, methanol, ethanol, 1-propanol, 2-propanol, and 1-butanol. Such organic solvents may be used alone or as a mixture of two or more thereof, or may be used as a mixture with water.

A polymerization temperature should be selected while taking account of the molecular weight of the polymer to be yielded, kind of the initiator, etc. Although a temperature in the range of below 0° C. to above 100° C. can be used, it is preferred to conduct the polymerization at a temperature in the range of 50 to 100° C.

A reaction pressure can be suitably selected. However, it is preferred to use a pressure of generally about 1 to 100 $kg/cm^2$, especially about 1 to 30 $kg/cm^2$. The reaction time is generally 5 to 30 hours. The polymer obtained may be purified by, e.g., reprecipitation.

The polymerizable composition will be explained next.

(Polymerizable Composition)

The polymerizable composition to be used for producing the inkjet recording head of the invention is a resin composition which at least contains a fluorine-containing polymerizable polymer, e.g., either of the fluorine-containing polymerizable polymers of the invention described above. It is a composition comprising the fluorine-containing polymerizable polymer, which contains fluorine and radical-polymerizable groups, and a solvent in which the polymer is dissolved, emulsified, or dispersed. The composition may further contain other ingredients suitably selected according to need.

-Solvent-

The solvent to be contained in the polymerizable composition is not particularly limited as long as the fluorine-containing polymerizable polymer is evenly dissolved or dispersed therein without precipitating. Two or more solvents may be used in combination.

It is preferred in the invention to use a highly safe solvent. A highly safe solvent is a solvent having a high value of control concentration (index in accordance with Working Environment Evaluation Standards). Preferred solvents are ones having a control concentration of 100 ppm or higher, and more preferred solvents are ones having a control concentration of 200 ppm or higher. From the standpoint of enabling a film to be formed in an appropriate time period, it is preferred to use a solvent which volatilizes upon heating at a temperature in the range of from room temperature to 150° C. Preferred examples thereof include ketones (e.g., acetone, methyl ethyl ketone, and methyl isobutyl ketone), esters (e.g., ethyl acetate and butyl acetate), ethers (e.g., tetrahydrofuran and 1,4-dioxane), alcohols (e.g., methanol, ethanol, isopropyl alcohol, 2-butanol, and ethylene glycol), aromatic hydrocarbons (e.g., toluene and xylene), and water.

-Other Ingredients-

The polymerizable composition for resin film formation of the invention is usually in a liquid form and contains the fluorine-containing polymerizable polymer as an essential component. In producing the composition, various additives and a polymerization initiator are dissolved in an appropriate solvent and added according to need. Although the concentration of such optional ingredients is suitably selected according to uses, it is generally about 0.01 to 60% by weight, preferably about 0.5 to 50% by weight, especially preferably about 1 to 20% by weight, on a solid basis.

Such other ingredients to be used will be explained below.

1) Polymerization Initiator and Sensitizer

As a polymerization initiator can be used either of the type which generates a radical by the action of heat and the type which generates a radical by the action of light.

The photopolymerization initiator is not particularly limited as long as it generates a radical or another active species upon light irradiation and the radical or active species reacts with the polymerizable double bond of the monomer. Generally known examples thereof include acetophenone derivatives, benzophenone derivatives, benzil derivatives, benzoin derivatives, benzoin ether derivatives, benzyl dialkyl ketal derivatives, thioxanthone derivatives, acylphosphine oxide derivatives, metal complexes, p-dialkylaminobenzoic acids, azo compounds, and peroxide compounds. Preferred of these are acetophenone derivatives, benzil derivatives, benzoin ether derivatives, benzyl dialkyl ketal derivatives, thioxanthone derivatives, and acylphosphine oxide derivatives. Especially preferred are acetophenone derivatives, benzoin ether derivatives, benzyl dialkyl ketal derivatives, and acylphophine oxide derivatives.

Specific examples of the photopolymerization initiator include acetophenone, 2,2-diethoxyacetophenone, p-dimethylaminoacetophenone, p-dimethylaminopropiophenone, benzophenone, p,p'-dichlorobenzophenone, p,p'-bisdiethylaminobenzophenone, Michler's ketone, benzil, benzoin, benzoin methyl ether, benzoin isopropyl ether, benzoin n-propyl ether, benzoin isobutyl ether, benzyl dimethyl ketal, 1-hydroxycyclohexyl phenyl ketone, tetramethylthiuram monosulfide, thioxanthone, 2-chlorothioxanthone, 2,4-dimethylthioxanthone, 2,2-dimethylpropioyldiphenylphosphine oxide, 2-methyl-2-ethylhexanoyldiphenylphosphine oxide, 2,6-dimethylbenzoyldiphenylphosphine oxide, 2,6-dimethoxybenzoyldiphenylphosphine oxide, 2,4,6-trimethylbenzoyldiphenylphosphine oxide, bis(2,6-dimethoxybenzoyl)-2,4,4-trimethylpentylphosphine oxide, 2,3,6-trimethylbenzoyldiphenylphosphine oxide, bis(2,3,6-trimethylbenzoyl)phenylphosphine oxide, 2,4,6-trimethoxybenzoyldiphenylphosphine oxide, 2,4,6-trichlorobenzoyldiphenylphosphine oxide, 2,4,6-trimethylbenzoyl naphthylphosphonate, bis($\eta^5$-2,4-cyclopentadien-1-yl)bis(2,6-difluoro-3-(1H-pyrro l-1-yl) phenyl)titanium, p-dimethylaminobenzoic acid, p-diethylaminobenzoic acid, azobisisobutyronitrile, 1,1'-azobis (1-acetoxy-1-phenylethane), benzoin peroxide, and di-tert-butyl peroxide.

Other examples of the photopolymerization initiator include the photopolymerization initiators shown in Kiyoshi Kato, *Shigaisen Kôka Shistemu*, (published by K. K. Sogo Gijutsu Center on 1989) pp. 65–148.

Those photopolymerization initiators can be used alone or in combination of two or more thereof, and may be used in combination with a sensitizer.

A sensitizer is an agent which does not activate upon light irradiation when used alone but which, when used in combination with a photopolymerization initiator, brings about a higher effect than in the case of using the photopolymerization initiator alone. An amine is generally used as the sensitizer. The reasons why addition of an amine heightens the rate of curing are as follows. First, the amine supplies hydrogen to the photopolymerization initiator based on its function of abstracting hydrogen. Secondly, although radicals generated combine with oxygen molecules present in the air to come to have impaired reactivity, the amine functions to captures the oxygen dissolved in the composition.

Examples of the sensitizer include amine compounds (e.g., aliphatic amines, amines containing an aromatic group, piperidine, products of the reaction of an epoxy resin with an amine, and triethanolamine triacrylate), urea compounds (e.g., allylthiourea and o-tolylthiourea), sulfur compounds (e.g., sodium diethyl dithiophosphate and soluble salts of aromatic sulfinic acids), nitrile compounds (e.g., N,N-diethyl-p-aminobenzonitrile), phosphorus compounds (e.g., tri-n-butylphosphine and sodium diethyl dithiophosphite), nitrogen compounds (e.g., Michler's ketone, N-nitrosohydroxylamine derivatives, oxazolidine compounds, tetrahydro-1,3-oxazine compounds, and condensates of formaldehyde or acetaldehyde with a diamine), and chlorine compounds (e.g., carbon tetrachloride and hexachloroethane).

A sensitizer is not an ingredient which should be inevitably used. However, in the case of using a sensitizer, the amount of the sensitizer to be used is generally 10% by weight or smaller, preferably 0.1 to 10% by weight, especially preferably 0.2 to 5% by weight, based on all solid components. A combination of a photoinitiator and a sensitizer and a proportion between these may be suitably selected according to the ultraviolet-curable monomer to be used and the apparatus to be used.

The amount of the polymerization initiator to be added is not particularly limited as long as it is effective in initiating the polymerization of carbon-carbon double bonds. In general, however, the amount thereof is preferably 0.1 to 15% by weight, more preferably 0.5 to 10% by weight, especially preferably 2 to 5% by weight, based on all solid components of the polymerizable composition for resin film formation.

2) Stabilizer for Storage

A stabilizer for storage serves to inhibit undesirable polymerization during storage. The polymerizable composition of the invention preferably contains this stabilizer. The stabilizer for storage to be used is one which dissolves in the solvents shown above and is capable of being present in a dissolved state in the composition. Examples thereof include quaternary ammonium salts, hydroxyamines, cyclic amides, nitriles, substituted ureas, heterocyclic compounds, organic acids, hydroquinone, hydroquinone monoethers, organic phosphines, and copper compounds. Specific examples thereof include benzyltrimethylammonium chloride, diethylhydroxylamine, benzothiazole, 4-amino-2,2,6,6-tetramethylpiperidine, citric acid, hydroquinone monomethyl ether, hydroquinone monobutyl ether, and copper naphthenate.

It is preferred that the amount of the stabilizer for storage to be used besuitably regulated according to the activity of the polymerization initiator to be used, polymerizability of polymerizable vinyl groups, and kind of the stabilizer for storage. In general, however, the amount thereof is preferably 0.005 to 1% by weight, more preferably 0.01 to 0.5% by weight, especially preferably 0.01 to 0.2% by weight, based on all solid ingredients. Addition of the stabilizer in an amount of 0.005% by weight or larger improves storage stability. Regulating the stabilizer amount to 1% by weight or smaller enables a polymerization reaction (curing) to proceed smoothly after film formation.

3) Additives

A hardener such as, e.g., a polyfunctional (meth) acrylate compound, a compound having two or more reactive groups (e.g. epoxy, oxetane, cyclic acetal, cyclic lactone, cyclic thioether, spiro-orthoester, vinyl ether, or isocyanate groups), a reactive silane coupling agent, an aminoplast, or a polybasic acid or an anhydride thereof, fine inorganic particles such as, e.g., silica, or fine conductive particles (e.g., fine particles of a conductive metal oxide such as ITO, ATO, $Sb_2O_3$, $SbO_2$, $In_2O_3$, $SnO_2$, conductive ZnO, AZO (zinc oxide doped with aluminum), or antimony-zinc pentoxide, a conductive nitride such as titanium nitride, zirconium nitride, or hafnium nitride, or particles of a metal such as gold, silver, or copper) may be added from the standpoint of, e.g., interfacial adhesion to substrates. In the case where such additives are added, the amount thereof is preferably 30% by weight or smaller, more preferably 20% by weight or smaller, especially preferably 10% by weight or smaller, based on all solid components of the polymerizable composition for resin film formation.

In the case where a compound containing a reactive group other than radical-polymerizable groups is used as an additive or where the fluorine-containing polymerizable polymer contains reactive groups other than radical-polymerizable groups, it is preferred to use the radical-generating polymerization initiator in combination with a cationic polymerization initiator or a crosslinking reaction accelerator.

It is also possible to suitably add a known, silicone or fluorochemical, antifouling or slip agent or the like for the purpose of further enhancing properties such as antifouling properties and water resistance. In the case of adding such additives, the amount thereof is preferably 20% by weight or smaller, more preferably 10% by weight or smaller, especially preferably 5% by weight or smaller, based on all solid components of the polymerizable composition for resin film formation.

As described above, all the polymerizable composition s described above can be used for producing the inkjet recording head of the invention. However, the polymerizable composition of the invention preferably contains the stabilizer for storage besides either of the fluorine-containing polymerizable polymers of the invention described above.

(Methods of Resin Film Formation)

In forming a resin film from the polymerizable composition described above, a film of the polymerizable composition for resin film formation is formed on a surface of a nozzle plate by dip coating or another coating technique and a crosslinking reaction is then conducted with the aid of actinic energy rays or heat. The nozzle plate to be used may be made of a known material such as, e.g., a metal, ceramic, silicone, glass, or plastic.

As the actinic energy rays can be used α-rays, γ-rays, X-rays, ultraviolet, visible light, electron rays, or the like. From the standpoints of cost and safety, it is preferred to use ultraviolet or visible light among these energy rays. More preferred is ultraviolet.

Light sources usable for irradiation with ultraviolet or visible light include a low-pressure mercury lamp, high-pressure mercury lamp, metal halide lamp, carbon arc lamp, xenon lamp, and chemical lamp.

In general, the radical-assisted polymerization reactions of polymerizable vinyl groups are inhibited by oxygen. However, the polymerizable composition for resin film formation of the invention has excellent polymerizability because it has polymerizable vinyl groups introduced in side chains and thus enables the polymerizable groups to retain mobility and because of a moderate content of the groups. The composition can hence cure sufficiently even through a polymerization reaction at ordinary temperature in air. It is, however, possible to conduct a polymerization reaction under conditions including a reduced oxygen concentration or heating.

In the case where heating is conducted, the resin film is heated at a temperature in the range of preferably about 30 to 200° C., more preferably 30 to 150° C., even more preferably 30 to 120° C., especially preferably 30 to 100° C. The heating time is in the range of preferably from 30 seconds to 100 hours, more preferably from 1 minute to 1 hour, especially preferably 2 to 15 minutes.

The inkjet recording head of the invention is an ink-jet recording head which comprises a nozzle having: a hole (or, discharge hole or nozzle hole) for discharging a recording liquid including an ink; and a portion capable of repelling the ink (or ink-repellent part) at the periphery of the hole This recording head is characterized in that the ink-repellent parts comprise a crosslinked resin formed through crosslinking from a polymerizable composition comprising a fluorine-containing polymerizable polymer and that the fluorine-containing polymerizable polymer is a polymer comprising a structural unit containing a fluorine atom and a structural unit containing a radical-polymerizable group. Namely, the ink-repellent parts comprise a crosslinked resin formed by crosslinking the polymerizable composition described above. The term "crosslinked resin formed by crosslinking the polymerizable composition" herein means a crosslinked resin obtained by applying the polymerizable composition, subsequently drying the composition to vaporize the solvent and thereby form a resin film, and then applying actinic energy rays, heat, or the like to the film to polymerize the polymerizable polymer in the polymerizable composition and thereby form a crosslinked structure.

(Formation of Ink-Repellent Parts)

It is preferred that in forming the ink-repellent parts, a coating fluid of the polymerizable composition be applied either directly or through another layer to the base which will be described later.

The coating fluid is prepared by mixing/diluting a matrix binder solution containing the fluorine-containing polymerizable polymer, and optionally a dispersion of ultrafine particles of a specific inorganic compound and other additives with a dispersion medium for coating in respective given concentrations.

It is preferred that the coating fluid be filtered before application. The filter to be used for filtration preferably is one whose pore diameter is as small as possible as long as none of the components of the coating fluid is removed. For the filtration is used a filter having an absolute precision of filtration of 0.1 to 100 μm. More preferably, a filter having an absolute precision of filtration of 0.1 to 25 μm is used. The thickness of the filter is preferably 0.1 to 10 mm, more preferably 0.2 to 2 mm. In this case, the filtration is conducted at a pressure of preferably 15 kgf/cm$^2$ or lower, more preferably 10 kgf/cm$^2$ or lower, even more preferably 2 kgf/cm$^2$ or lower.

The filter medium to be used is not particularly limited as long as it does not influence the coating fluid.

It is also preferred that the coating fluid which has been filtered be subjected, just before application, to an ultrasonic dispersion treatment to promote defoaming and help the dispersed ingredients in retaining the dispersed state.

In the invention, a resin film can be formed on the base which will be described later by applying the polymerizable composition by a known technique for thin-film formation, such as dip coating, air knife coating, curtain coating, roller coating, wire-wound bar coating, gravure coating, micro-gravure coating, or extrusion coating, subsequently drying the composition applied, and then treating the dry film with light and/or heat. Curing by light irradiation is preferred because it is advantageous in rapid curing. It is also preferred to conduct a heat treatment in a later stage in a photocuring treatment.

As a light source for light irradiation may be used any light source capable of emitting ultraviolet or near infrared rays. Examples of ultraviolet light sources include ultrahigh-pressure, high-pressure, medium-pressure, and low-pressure mercury lamps, chemical lamps, carbon arc lamps, metal halide lamps, xenon lamps, and sunlight. Various available lasers emitting a light having a wavelength of 350 to 420 nm may be used to conduct multi-beam irradiation. Examples of near-infrared light sources include halogen lamps, xenon lamps, and high-pressure sodium lamps. Various available lasers emitting a light having a wavelength of 750 to 1,400 nm may be used to conduct multi-beam irradiation.

In the case of using a near-infrared light source, it may be used in combination with an ultraviolet light source or may be used to irradiate the resin film from that side of the base which is opposite to the resin film-coated side. This irradiation enables the coating film to cure evenly, i.e., curing of inner parts of the layer proceeds at a rate not lower than that for near-surface parts, resulting in a resin film in an evenly cured state.

In the case of radical polymerization, it may be conducted in air or inert gas. It is, however, preferred to use an atmosphere having an oxygen concentration reduced to the lowest possible level for the purpose of, e.g., shortening the induction period for the polymerization of the radical-polymerizable monomer or sufficiently heightening the conversion into polymer. In the case of photopolymerization, the intensity of the ultraviolet with which the coating film is irradiated is preferably about 0.1 to 500 mW/cm$^2$ and the quantity of irradiation light as measured on the coating film surface is preferably 100 to 1,000 mJ/cm$^2$. In the light irradiation step, the narrower the temperature distribution for the coating film, the better. The width of the temperature distribution is regulated to preferably within ±3° C., more preferably within ±1.5° C. This range is preferred because polymerization reaction in the coating film proceeds evenly throughout the plane of the layer and throughout the thickness thereof.

The thickness of the ink-repellent parts (resin film) in the invention is not particularly limited. However, it is preferably 0.01 to 100 μm, more preferably 0.1 to 10 μm, especially preferably 0.5 to 5 μm.

(Ink-Repellent Parts of Inkjet Recording Head)

The inkjet recording head to be subjected to the ink-repellent treatment according to the invention may be any of known liquid-discharging heads which discharge minute droplets. Examples thereof include the heads operated by various recording techniques as described in, e.g., Pond Stephen F., *Inkjet Technology and Product Development Strategies* (Torrey Pines, published in 1998), *Inku Jetto Purintâ Gijutsu To Zairyô*, supervised by Takeshi Kanri (CMC Publishing Co., Ltd., published in 1998), and *Inku Jetto Kiroku To Purintâ Kiroku Hôshiki To Purintâ Heddo No Kaihatsu*, (CMC Publishing Co., Ltd., published in 2000). Specific examples thereof include continuous-jet heads such as the charge control type and the pressure oscillation type and on-demand inkjet heads such as the electrical/mechanical conversion type (e.g., piezoelectric type), electrical/thermal conversion type (bubble jet type), electrostatic attraction type, and ultrasonic type.

The peripheral parts in which the ink-repellent parts are to be formed preferably are at least ink the periphery parts of the droplet-discharge holes in any of those various recording heads. For example, in an inkjet recording head which has a recording head unit comprising: an inkjet recording head comprising discharge holes for discharging an ink and ink passages connected to the discharge holes; and an ink feed member for feeding an ink to the ink passages, and an ink tank unit for storing the ink to be fed to the ink passages by the ink feed member, it is, for example, preferred that those parts of the discharging part (nozzle)-constituting member at the periphery of the nozzle hole tips be converted to ink-repellent parts. Specifically, as shown in the FIGURE, the ink-jet recording head of one embodiment in the invention comprises a nozzle having a nozzle plate 1 and a nozzle hole 2 (an discharge hole) in the nozzle plate 1. A cured film is formed on the outer surface of the nozzle plate 1, thereby forming an ink repelling treated portion 3.

However, the parts to which ink repellency is to be imparted should not be construed as being limited to those parts, and can vary depending on the recording mode, head structure, etc.

(Method for Forming Ink-Repellent Parts)

The ink-repellent treatment of a nozzle plate may be conducted either before or after nozzle formation therein.

The diameter of the nozzle holes to be formed in the nozzle plate is preferably 15 to 100 μm, more preferably 20 to 60 μm, in terms of the diameter of each ink droplet-discharge opening.

Examples of methods for forming such nozzle holes include press working, electroforming, excimer laser processing, and a photofabrication technique.

In the case where an ink-repellent treatment is conducted after nozzle hole formation, it is preferred to use, for example, a method in which the nozzle holes are closed with a resist and the resist is removed after the treatment or a method in which the treatment is conducted while passing a gas through the nozzle holes. It is also preferred to use a masking method in order to precisely regulate the positions in which the polymerizable composition for the ink-repellent treatment comes into the nozzle holes through the ink droplet-discharge openings and to precisely regulate the amount of the composition thus coming into the nozzle holes.

In the case where the nozzle plate is to be bonded to a head part after the ink-repellent treatment, it is preferred that the back side of the plate be not subjected to the ink-repellent treatment.

As the nozzle plate to be subjected to the treatment in the invention, a known base is used. For example, the base is made of a metal, ceramic, silicone, glass, or plastic. Examples of the material of the base include elemental metals such as titanium, chromium, iron, cobalt, nickel, copper, zinc, tin, and gold, alloys such as nickel-phosphorus alloys, tin-copper-phosphorus alloys (phosphor bronze), copper-zinc alloys, and stainless steel 40, and materials formed from organic resin materials having thermosetting properties, solvent resistance, chemical resistance, and heat resistance (e.g., thermosetting polyimides, polyethersulfones, polyphenylene, polycarbonates, polysulfones, ABS resins (acrylonitrile/butadiene/styrene copolymers), poly (ethylene terephthalate), poly(ethylene naphthalate), polyacetals, and sulfides) or from various photosensitive resins.

A multilayer structure formed by bonding two or more of those materials may also be used. For example, by bonding an organic resin material to a high-rigidity inorganic material, such as a metal or a ceramic, a nozzle plate which as a whole has heightened rigidity can be obtained. Namely, organic resin materials have a Young's modulus of about 100 to 300 kg/mm$^2$, which is far lower than 8,000 to 15,000 kg/mm$^2$ for metals and 10,000 to 20,000 kg/mm$^2$ for ceramics. Because of this, there are cases where nozzle plates made of one or more organic resin materials alone deform due to the pressure for inkjet discharging and this results in a pressure loss and a decrease in the ink droplet speed Vj. However, by bonding a high-rigidity material to the lower side of such a resin material with a thin-film adhesive (adhesive layer), the overall rigidity is improved.

The thickness of the plate is preferably about 30 to 50 μm from the standpoints of the strength required for processing, load of energy necessary for processing, lightweight properties required of heads, etc.

That surface of the base on which a resin film constituting ink-repellent parts according to the invention is to be formed preferably has irregularities.

The surface irregularities produce an anchoring effect to enable the resin film in the ink-repellent parts to retain tight adhesion to the base surface. In addition, the strength of the resin film is improved.

That surface of the base on which a resin film constituting ink-repellent parts is to be formed preferably has a surface having a surface shape such that an arithmetical mean roughness (Ra) of surface irregularities, based on JIS B0601-1994, is not more than 0.5 μm, that a ratio (Ra/Rz) of an arithmetical mean roughness (Ra) to a ten-point mean roughness (Rz) is 0.1 or more, that a maximum height (Ry) is not more than 0.5 μm, and that a mean space of surface irregularities (Sm) is in the range of from 0.005 to 1 μm. It is more preferable that Ra is from 0.01 to 0.3 μm, that the ratio (Ra/Rz) of Ra to the ten-point mean roughness (Rz) is 0.15 or more, that the maximum height (Ry) is not more than 0.3 μm, and that the mean space of surface irregularities (Sm) is from 0.001 to 0.5 μm.

Such ranges are preferred because when the base surface has values of surface properties within those ranges, a resin film constituting ink-repellent parts can be evenly formed and adhesion thereof can be satisfactorily maintained.

In the case where a resin film constituting ink-repellent parts is formed on a base not directly but through an interlayer, which will be described below, it is preferred that the interlayer on which a resin film constituting ink-repellent parts is to be formed be made to have surface irregularities before the polymerizable composition is applied thereto. The preferred ranges of the properties of the surface irregularities thereof are the same as those shown above.

(Interlayer)

The ink-repellent parts may have at least one interlayer disposed between the nozzle plate (base) and the resin film formed by the ink-repellent treatment. It is preferred that the interlayer be made to have functions such as, e.g., adhesion, hardness, priming properties, and electrical conductivity.

An interlayer having adhesion is preferred, and may be any of an inorganic layer, an organic layer, and an inorganic/organic hybrid layer. A suitable one is selected according to the base/ink-repellent part combination from the standpoint of adhesion. It is preferred that the interlayer further has hardness (layer having a pencil hardness of 2 or higher, preferably 3 or higher). It is also preferred that electrical conductivity is further imparted thereto.

In the case of an interlayer comprising an organic layer or an inorganic/organic hybrid layer, this interlayer is preferably formed through the crosslinking or polymerization reaction of a curable compound with the aid of light and/or heat. For example, the interlayer can be formed by applying a coating composition containing a polyester (meth)acrylate, polyurethane (meth)acrylate, polyfunctional monomer, polyfunctional oligomer, or organometallic compound containing a hydrolyzable functional group on a transparent substrate and causing the compound to undergo a crosslinking reaction or polymerization reaction.

The functional groups undergoing a curing reaction preferably are photopolymerizable functional groups. The organometallic compound containing a hydrolyzable functional group preferably is an organic alkoxysilyl compound. By suitably incorporating fine particles usable in the polymerizable composition for forming ink-repellent parts, the hardness of the interlayer is improved. Furthermore, electrical conductivity can be imparted by incorporating the fine conductive particles shown above.

In the case where the interlayer directly underlies the ink-repellent parts according to the invention, the surface of the layer preferably has irregularities.

The surface irregularities produce an anchoring effect to enable the resin film in the ink-repellent parts to retain tight adhesion to the interlayer. In addition, the strength of the ink-repellent resin film is improved.

The preferred ranges of the surface shape properties of the interlayer are the same as those for the base surface on which a resin film constituting ink-repellent parts is to be formed.

(Methods for Imparting Surface Irregularities)

For forming fine surface irregularities described above on that surface of the base or interlayer on which a resin film constituting ink-repellent parts is to be formed, use can be made of known methods, such as a method for modifying the shape of a base surface, a method in which an interlayer originally having fine surface irregularities is formed, or a method comprising a combination of these.

Examples of the method for modifying the shape of a base include a dry etching technique. In the case where the base is an organic layer, examples thereof further include an embossing technique in which irregularities are transferred to the film surface from an embossing plate or stamping die sheet.

Examples of the dry etching technique include the glow discharge etching, flame plasma etching, corona discharge etching, and etching with electron ray energy irradiation which are described in, e.g., *Hyômen Shori Gijutsu Handobukku -Setchaku/Tosô Kara Denshi Zairyô Made-*, supervised by Hiroshi Mizumachi and Mitsuru Tobayama, 2nd volume, 3rd section (NTS Inc., published in 2000), Shigeo Tazuke et al., *Kôbunshi No Bîmu Kakô -Hikari/Purazuma/Hôshasen No Riyô-* (CMC Publishing Co., Ltd., published in 1986), and *Purazuma Ion Bîmu Ôyô To Nanotekunorojî*, supervised by Eiji Kamijo, chapters 1–4 (CMC Publishing Co., Ltd., published in 2002).

In the embossing technique, any of a flat press, continuous belt press, and roll press can be employed. For the continuous processing of a strip work, a continuous belt press and a roll press are preferred of these. Most preferred is a roll press from the standpoint of the degree of freedom of pressing pressure and pressing temperature.

Examples of the interlayer to which surface irregularities are to be imparted include: a metal oxide film obtained by applying a sol-gel reaction product obtained by the hydrolysis of an organometallic compound having a hydrolyzable group and then subjecting the coating to heating or plasma irradiation; and a cured film obtained by applying a composition comprising a light- and/or heat-curable compound and fine particles.

(Properties of Ink-Repellent Parts)

(Surface Shape)

The surface of the ink-repellent parts, i.e., the side having nozzle holes, preferably has a shape having an arithmetic average surface roughness (Ra) of 1 μm or lower, a maximum height (Ry) of 3 μm or smaller, and an average surface recess/protrusion interval (Sm) of 15 μm or shorter. More preferably, the roughness (Ra) is 0.01 to 0.5 μm, the maximum height (Ry) is 2 μm or smaller, and the average surface recess/protrusion interval (Sm) is 0.02 to 10 μm.

By regulating the ink-repellent parts so as to have such a surface state, the ink repellency of the ink-repellent parts is sufficiently retained even when the nozzle hole side is wiped with a wiper made of a rubber, cloth, etc.

(Antistatic Properties)

It is preferred that when an electrostatic voltage is imparted to the surface of the ink-repellent parts and this surface is examined for electrostatic-voltage attenuation, then the time required for the amount of charges to decrease to one-half its initial value (hereinafter referred to as "electrostatic-voltage half-life period") be 60 seconds or shorter.

In particular, an electrostatic-voltage half-life period of 30 seconds or shorter is desirable because it is highly effective. Electrostatic-voltage half-life periods longer than 60 seconds are undesirable because the antistatic effect after the formation of the ink-repellent parts is insufficient and the effect of preventing dust adhesion is lessened by wiping operations, etc.

A method for measuring the electrostatic-voltage half-life period is as follows. First, the surface of an article is charged with a direct-current corona discharge while monitoring the electrostatic voltage of the surface with an electrostatic potential meter. With progress of the discharge, the electrostatic voltage increases and is saturated at a given potential. This potential is taken as a saturation voltage. The discharge is stopped, and the time period from this moment to the time at which the electrostatic voltage decreases to one-half the saturation voltage is measured.

(Inkjet Recorder)

The polymerizable composition can be used for forming ink-repellent part son an inkjet recording head which discharges minute droplets. An inkjet recording head having such ink-repellent parts can be used as any of the recording heads operated by various inkjet recording techniques. Examples thereof include the inkjet recording heads described in, e.g., the publications shown above under "Recording Head".

The invention is applicable to an appropriate apparatus, other than inkjet recorders, in which minute droplets are ejected through minute nozzle holes and the nozzle plate is required to have liquid repellency. Examples of the liquid include coating materials (varnishes), solvents, and medicinal fluids.

The invention will be explained below by reference to Examples thereof, but the invention should not be construed as being limited to these Examples in any way. Hereinafter, "%" means "% by weight" unless otherwise indicated.

EXAMPLES (Synthesis of Fluorine-Containing Polymerizable Polymer (P-1))

Into a stainless-steel autoclave having a capacity of 100 mL and equipped with a stirrer were introduced 40 mL of ethyl acetate, 14.7 g of hydroxyethyl vinyl ether, and 0.55 g of dilauroyl peroxide. The atmosphere in the system was evacuated and replaced with nitrogen gas. Into the autoclave was further introduced 25 g of hexafluoropropylene (HFP). The contents were heated to 65° C. The internal pressure as measured at the time when the temperature in the autoclave had reached 65° C. was 5.4 kg/cm$^2$. This temperature was maintained to continuously react the mixture for 8 hours. At the time when the pressure had reached 3.2 kg/cm$^2$, the heating was stopped and the reaction mixture was allowed to cool. At the time when the internal temperature had declined to room temperature, the monomers remaining unreacted were removed and the autoclave was opened to take out the liquid reaction mixture. The reaction mixture obtained was poured into a large excess of hexane, and the solvent was removed by decantation to thereby obtain a polymer precipitated. An operation in which this polymer was dissolved in a small amount of ethyl acetate and reprecipitated from hexane was conducted twice to thereby completely remove the residual monomers. This precipitate was dried. Thus, a fluorine-containing polymerizable polymer (a-1) made up of hexafluoropropylene and hydroxyethyl vinyl ether in a molar ratio of 1:1, which had the structure shown below, was obtained in an amount of 28 g. Subsequently, 20 g of the polymer was dissolved in 100 mL of N,N-dimethylacetamide. Thereto was dropwise added 11.4 g of acryloyl chloride with cooling with ice. This mixture was stirred at room temperature for 10 hours. Ethyl acetate was added to the reaction mixture, and the resultant solution was washed with water. The organic layer was extracted and then concentrated, and the polymer obtained was reprecipitated from hexane. Thus, a fluorine-containing polymerizable polymer (P-1) was obtained in an amount of 19 g. The polymer obtained had a number-average molecular weight of 31,000.

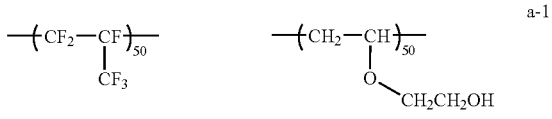

a-1

(Synthesis of Fluorine-Containing Polymerizable Polymer (P-13))

In 28 g of methyl isopropyl ketone were dissolved 15.5 g of the hexafluoropropylene/hydroxypropyl vinyl ether copolymer (a-1) described in the Synthesis Example for fluorine-containing polymerizable polymer (P-1), 12.1 g of methacryloyloxypropyl isocyanate, and 25 mg of dibutyltin dilaurate. This solution was stirred for 4 hours with heating at 50° C. The resultant reaction mixture was poured into a large excess of hexane to precipitate a polymer, which was taken out. An operation in which this polymer was dissolved in a small amount of ethyl acetate and reprecipitated from hexane was conducted twice to thereby completely remove the residual monomer. Thus, a fluorine-containing polymerizable polymer (P-13) was obtained in an amount of 19 g. The polymer obtained had a number-average molecular weight of 32,000.

(Synthesis of Fluorine-Containing Polymerizable Polymer (P-15))

Into a stainless-steel autoclave having a capacity of 100 mL and equipped with a stirrer were introduced 30 mL of ethyl acetate, 11.5 g of glycidyl vinyl ether, and 0.42 g of dilauroyl peroxide. The atmosphere in the system was evacuated and replaced with nitrogen gas. Into the autoclave was further introduced 21 g of hexafluoropropylene (HFP) The contents were heated to 65° C. The internal pressure as measured at the time when the temperature in the autoclave had reached 65° C. was 6.2 kg/cm$^2$. This temperature was maintained to continuously react the mixture for 8 hours. At the time when the pressure had reached 3.6 kg/cm$^2$, the heating was stopped and the reaction mixture was allowed to cool. At the time when the internal temperature had declined to room temperature, the monomers remaining unreacted were removed and the autoclave was opened to take out the liquid reaction mixture. The reaction mixture obtained was poured into a large excess of hexane, and the solvent was removed by decantation to thereby obtain a polymer precipitated. An operation in which this polymer was dissolved in a small amount of ethyl acetate and reprecipitated from hexane was conducted twice to thereby completely remove the residual monomers. This precipitate was dried. Thus, a copolymer of hexafluoropropylene and glycidyl vinyl ether was obtained in an amount of 21 g. Subsequently, 15 g of the polymer, 10.6 g of acrylic acid, 0.13 g of benzyltriethylammonium chloride, and 84 mg of Irganox 1010 (trade name; polymerization inhibitor manufactured by Ciba-Geigy Ltd.) were dissolved in 30 g of methyl isobutyl ketone. This solution was heated at 100° C. for 5 hours. The resultant reaction mixture was poured into a large excess of hexane to precipitate a polymer, which was taken out. An operation in which this polymer was dissolved in a small amount of ethyl acetate and reprecipitated from hexane was conducted twice to thereby completely remove the residual monomers. Thus, a fluorine-containing polymerizable polymer (P-15) was obtained in an amount of 20 g. The polymer obtained had a number-average molecular weight of 28,000.

(Synthesis of Fluorine-Containing Polymerizable Polymer (P-34))

A liquid mixture consisting of 23.0 g of 1H, 1H, 2H, 2H-perfluorodecyl acrylate, 5.2 g of hydroxyethyl acrylate, and 10 g of methyl ethyl ketone was prepared.

Subsequently, 5 g of isopropyl alcohol, 20 g of trifluoromethylbenzene, 10 g of methyl ethyl ketone, and 0.1 g of dimethyl 2,2'-azobis(2-methylpropionate) were introduced into a flask. The contents were heated to 80° C. with stirring and nitrogen sealing. Thereafter, the liquid mixture described above was added drop wise there to over 2 hours. After completion of the addition, 0.05 g of dimethyl 2,2'-azobis(2-methylpropionate) was added to the mixture to react it at that temperature for 2 hours. The resultant reaction mixture was poured into a large excess of hexane and the solvent was removed by decantation to thereby obtain a polymer precipitated.

This polymer was dissolved in a mixture of 40 mL of trifluoromethylbenzene and 40 mL of N,N-dimethylacetamide. Thereto was dropwise added 3.9 g of acryloyl chloride with cooling with ice. This mixture was stirred at room temperature for 10 hours. Ethyl acetate was added to the reaction mixture and the resultant solution was washed with water. The organic layer was extracted and then concentrated, and the polymer obtained was reprecipitated from hexane. Thus, a fluorine-containing polymerizable polymer (P-34) was obtained in an amount of 27 g. The polymer obtained had a number-average molecular weight of 32,000.

(Synthesis of Fluorine-Containing Polymerizable Polymer (P-60))

Into a flask were introduced 20 g of hydroxyethyl acrylate, 5 g of ethanol, 10 g of tetrahydrofuran, 0.89 g of 1-phenylethyl dithiobenzoate, and 0.1 g of 2,2'-azobisisobutyronitrile. This mixture was reacted at 60° C. for 10 hours with stirring and argon sealing. Furthermore, 0.05 g of 2,2'-azobisisobutyronitrile was added thereto and this mixture was reacted at that temperature for 15 hours. The resultant reaction mixture was poured into a large excess of acetonitrile and the solvent was removed by decantation to thereby obtain a polymer precipitated. This polymer was vacuum-dried.

Into a flask were introduced 2.8 g of the polymer, 46.6 g of 1H, 1H, 2H, 2H-perfluorooctyl acrylate, 3 g of ethanol, and 0.02 g of 2,2'-azobisisobutyronitrile. This mixture was reacted at 60° C. for 20 hours with stirring and argon sealing. Furthermore, 0.02 g of 2,2'-azobisisobutyronitrile was added thereto and this mixture was reacted at that temperature for 30 hours. The resultant reaction mixture was poured into a large excess of hexane and the solvent was removed by decantation to thereby obtain a polymer precipitated. The polymer obtained was dissolved in a mixture of 20 mL of trifluoromethylbenzene and 5 mL of N,N-dimethylacetamide. Thereto was dropwise added 10 g of acryloyl chloride with cooling with ice. This mixture was stirred at room temperature for 10 hours. Ethyl acetate was added to the reaction mixture and the resultant solution was washed with water. The organic layer was extracted and then concentrated, and the polymer obtained was reprecipitated from hexane. Thus, a fluorine-containing polymerizable polymer (P-60) was obtained in an amount of 23 g. The polymer obtained had a number-average molecular weight of 32,000. The proportions of structural units were calculated from an NMR spectrum.

(Preparation of Polymerizable Composition s for Resin Film Formation)

The ingredients shown in Table 1 given below were mixed together, and this mixture was dissolved in methyl ethyl ketone. The solution was filtered through a polypropylene filter having a pore diameter of 1 μm. Thus, polymerizable compositions for resin film formation were prepared.

The polymers other than those described in the Synthesis Examples given above were obtained in the same manners as in the Synthesis Examples, except that the compounds to be reacted were replaced by respective given compounds.

Each FIGURE in parenthesis shown in Table 1 represents parts by weight of each ingredient.

TABLE 1

| Polymerizable composition | Fluorine-containing polymerizable polymer | Additive | Polymerization initiator, sensitizer | Stabilizer for storage |
|---|---|---|---|---|
| L-1 (composition of the invention) | P-1 (100) | | IRG1870 (5) | MHQ (0.02) |
| L-2 (composition of the invention) | P-13 (100) | | IRG907 (7) | MHQ (0.02) |
| L-3 (composition of the invention) | P-15 (100) | | IRG1870 (5), EDA (3) | MHQ (0.02) |
| L-4 (composition of the invention) | P-15 (70) P-24 (30) | | IRG907 (5), DETX (2) | MHQ (0.02) |
| L-5 (composition of the invention) | P-24 (90) | PAA (10) | IRG1870 (5), EDA (2) | MHQ (0.02) |
| L-6 (composition of the invention) | P-32 (60) P-50 (40) | | IRG1870 (5), DEA (2) | MHQ (0.02) |
| L-7 (composition of the invention) | P-43 (100) | | IRG1870 (5), EDA (2) | MHQ (0.02) |
| L-8 (composition of the invention) | P-43 (90) | D110N (10) | IRG1870 (5), EDA (2) | MHQ (0.02) |
| L-9 (composition of the invention) | P-51 (99) | U (1) | IRG1870 (5), EDA (2) | MHQ (0.02) |
| L-10 (composition of the invention) | P-50 (100) | | IRG1870 (5), EDA (2) | MHQ (0.02) |
| L-11 (composition of the invention) | P-50 (95) | PAA (5) | IRG1870 (5), EDA (2) | MHQ (0.02) |
| L-12 (composition of the invention) | P-46 (100) | | IRG1870 (5), EDA (2) | MHQ (0.02) |
| L-13 (composition of the invention) | P-46 (90) | PET4A (10) | IRG1870 (5), EDA (2) | MHQ (0.02) |
| L-14 (composition of the invention) | P-60 (100) | | IRG1870 (5), EDA (2) | MHQ (0.02) |
| L-15 (composition of the invention) | P-60 (98) | TGE (2) | IRG1870 (5), EDA (2) | MHQ (0.02) |
| L-16 (composition of the invention) | P-63 (97) | TGE (3) | IRG1870 (5), EDA (2) | MHQ (0.02) |
| L-17 (composition of the invention) | P-62 (100) | | IRG1870 (5), EDA (2) | MHQ (0.02) |
| L-30 (comparative composition) | a-1 (90) | PET4A (10) | IRG1870 (5), EDA (2) | MHQ (0.02) |
| L-31 (comparative composition) | a-2 (90) | PET4A (10) | IRG1870 (5), EDA (2) | MHQ (0.02) |
| L-32 (comparative composition) | a-2 (90) | D110N (10) | IRG1870 (5), EDA (2) | MHQ (0.02) |
| L-33 (comparative composition) | a-3 (90) | PET4A (10) | IRG1870 (5), EDA (2) | MHQ (0.02) |

IRG907: Irgacure 907 (trade name; manufactured by Ciba-Geigy Ltd.); photopolymerization initiator IRG1870: Irgacure 1870 (trade name; manufactured by Ciba-Geigy Ltd.); photopolymerization initiator DETX: Kayacure DETX (trade name; manufactured by Nippon Kayaku Co., Ltd.); photosensitizer EDA: N-ethyldiethanolamine; polymerization accelerator MHQ: hydroquinone monomethyl ether; stabilizer for storage U: urea; film property regulator D110N: Takenate D110N (trade name; polyfunctional isocyanate compound manufactured by Takeda Chemical Industries, Ltd.); film property regulator TGE: trimethylolpropane triglycidyl ether; film property regulator PET4A: pentaerythritol tetraacrylate (polyfunctional acrylate compound); film property regulator PAA: acrylic acid/butyl acrylate copolymer (copolymerization ratio, 20:80 by mole; molecular weight, 6,000); film property regulator "a-2" is the compound shown below.

a-2

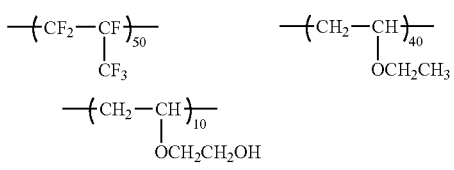

a-3: copolymer of macromonomer having poly(1H, 1H-perfluorooctyl acrylate) structure and glycidyl methacrylate (60/30 by weight)

EXAMPLE 1 AND COMPARATIVE EXAMPLE

Each of the resin compositions obtained was applied to a surface of a nozzle plate having nozzle holes formed therein. The compositions of the invention were subjected to a curing treatment in the manner shown below, while the comparative compositions were applied and dried. The resin compositions each were thus used to conduct an ink-repellent treatment and thereby obtain an inkjet recording head having ink-repellent parts. More specifically, the nozzle plate 1 in each head obtained has ink-repellent parts 3 consisting of a water-repellent resin film and formed in the periphery the nozzle holes 2. In the case of using each composition of the invention, the ink-repellent parts 3 were formed by: protecting the nozzle holes 2 of the nozzle plate 1 beforehand by applying a positive resist on the back side of the plate; applying the polymerizable composition to the front side of the nozzle plate 1 in such an amount as to result in a film thickness of 1 μm on a dry basis; irradiating the coating with ultraviolet in an amount of 300 mJ/cm$^2$ using a metal halide lamp; conducting the heat treatment shown in Table 2 to form a resin film; and then removing the resist. In this Example, a water-repellent resin film was disposed after nozzle holes were formed. However, use may be made of a method in which a water-repellent resin film is disposed on a nozzle plate having no nozzle holes, before nozzle holes are formed in the plate.

TABLE 2

| No. | Polymerizable composition | Curing treatment | Adhesion | Ink repellency |
|---|---|---|---|---|
| 1 (invention) | L-1 | none | A | A |
| 2 (invention) | L-2 | none | A | A |
| 3 (invention) | L-3 | none | A | A |
| 4 (invention) | L-4 | 90° C., 20 min | A | A |
| 5 (invention) | L-5 | 60° C., 10 min | A | A |
| 6 (invention) | L-6 | none | A | A |
| 7 (invention) | L-7 | none | A | A |
| 8 (invention) | L-8 | 60° C., 10 min | A | A |
| 9 (invention) | L-9 | 60° C., 15 min | A | A |
| 10 (invention) | L-10 | none | A | A |
| 11 (invention) | L-11 | 90° C., 20 min | A | A |
| 12 (invention) | L-12 | none | A | A |
| 13 (invention) | L-13 | none | A | A |
| 14 (invention) | L-14 | 60° C., 10 min | A | A |
| 15 (invention) | L-15 | 90° C., 20 min | A | A |
| 16 (invention) | L-16 | 90° C., 20 min | A | A |
| 17 (invention) | L-17 | 60° C., 15 min | A | A |
| 18 (comparative example) | L-30 | none | C | B |
| 19 (comparative example) | L-31 | none | C | B |
| 20 (comparative example) | L-32 | 60° C., 10 min | B | B |
| 21 (comparative example) | L-33 | 60° C., 10 min | B | B |

The inkjet recording heads according to the invention which employed nozzle plates produced were ascertained to stably discharge ink droplets from all nozzle holes. The heads were further subjected to the following durability test.

Adhesion: The surface of the nozzle plate was wet-wiped with a urethane rubber and then examined for marring or peeling to evaluate adhesion. The heads which suffered neither marring nor peeling are indicated by A; those which suffered slight marring and no peeling are indicated by B; and those which suffered peeling are indicated by C.

Ink Repellency: The nozzle plate was immersed in an ink in a 50° C. atmosphere for 3 days to examine ink repellency. The nozzle plates which retained almost the same ink repellency as that before the immersion are indicated by A, while those which deteriorated in ink repellency are indicated by B.

The results obtained are shown in Table 2.

The results given in Table 2 show the following. The fluorine-containing polymerizable polymers according to the invention can form a water-repellent resin film excellent in suitability for ink discharging, adhesion, and ink repellency, even without a heat treatment or through a mild heat treatment at 100° C. or lower. The inkjet recording heads of the invention, which were obtained with these fluorine-containing polymerizable polymers, are superior in durability to the comparative inkjet recording heads, which were obtained through an ink-repellent treatment with a polymer having no polymerizable group.

EXAMPLE 2

An interlayer was formed beforehand from an epoxy resin on a surface of the nozzle plate 1 shown in the FIGURE. Thereafter, polymerizable composition P-32 was applied thereon and heat-treated at 90° C. for 20 minutes to form a water-repellent resin film. This nozzle plate was evaluated in the same manners as in Example 1. As a result, the nozzle plate showed excellent suitability for ink discharging, and the adhesion and ink repellency thereof were rated as A, excellent.

EXAMPLE 3

Nozzle plates No. 14 and No. 17 obtained in Example 1 were evaluated for alkali ink resistance by the method shown below. As a result, nozzle plate No. 14, in which the structural unit containing the fluorine atom had an ester group, slightly deteriorated in ink repellency, while nozzle plate No. 17, in which the structural unit containing the fluorine atom had no ester group, suffered almost no deterioration. It was thus found that use of a fluorine-containing polymerizable polymer containing no ester group is more effective in enabling the water-repellent resin film to retain high frictional resistance over long.

Alkali Ink Resistance: The plate was immersed in an ink prepared by adding 1 N sodium hydroxide solution to a mixture of 4 g of copper phthalocyanine sulfonate, 9 g of diethylene glycol, 5 g of tetraethylene glycol monobutyl ether, 5 g of glycerol, 2 g of Olfin E1010 (trade name; manufactured by Air Products Inc.), and 75 g of water in such an amount as to result in a pH of 10. This ink was heated together with the plate at 80° C. for 4 hours. Thereafter, the plate was taken out and subjected 10 times to a wiping operation in which the plate was wet-wiped with a urethane rubber forward and backward 10 times. After completion of this operation, the plate was examined for any change in ink repellency from the state before the immersion.

The present application claims foreign priority based on Japanese Patent Application No. JP-2003-337028 filed Sep. 29 of 2003, the contents of which is incorporated herein by reference.

What is claimed is:

1. An inkjet recording head which comprises a nozzle having: a hole for discharging a recording liquid including an ink; and a portion capable of repelling the ink at the periphery of the hole, wherein the portion comprises a crosslinked resin formed from a polymerizable composition comprising a fluorine-containing polymerizable polymer, and the fluorine-containing polymerizable polymer comprises: a first structural unit having a fluorine atom; and a second structural unit having a radical-polymerizable group, wherein the crosslinked resin is formed from the polymerizable composition through a crosslinking reaction, the crosslinking reaction comprising a radical polymerization, wherein the first structural unit having the fluorine atom is a structural unit represented by one of formulae 1a, 1b, 1c and 1d; and the second structural unit having the radical-polymerizable group is a structural unit represented by formula 2:

1a

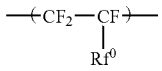

1b

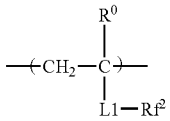

1c

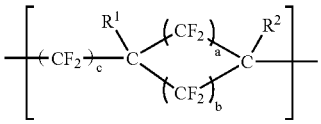

1d

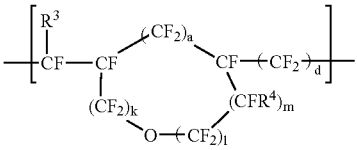

wherein $Rf^0$ represents a fluorine atom, a perfluoroalkyl group having 1 to 8 carbon atoms, or an —$ORf^1$ group, wherein $Rf^1$ represents a fluorine-containing aliphatic group having 1 to 30 constituent carbon atoms, $R^0$ represents a hydrogen atom, a fluorine atom, a methyl group, or a cyano group: L1 represents a covalent bond, —O—, —S—, —CO—, —COO—, —$CONR^{50}$—, —OCO—, —$OCONR^{51}$—, —$NR^{52}CO$—, —$NR^{53}COO$—, —$NR^{54}CONR^{55}$—, —SO—, —$SO_2$—, —$SO_2NR^{56}$—, —$NR^{57}SO_2$—, —$SiR^{58}R^{59}$—, —$PR^{60}$—, —$PO(OR^{61})O$—, —$OPO(OR^{62})$—, —$PO(OR^{63})NR^{64}$—, —$NR^{65}PO(OR^{66})$—, —$NR^{67}PO(NR^{68}R^{69})NR^{70}$—, or —$NR^{71}$—, wherein $R^{50}$ to $R^{71}$ each represents a hydrogen atom, a substituted alkyl group or an unsubstituted alkyl group; and $Rf^2$ represents a hydrocarbon group in which a hydrogen atom is replaced with a fluorine atom in at least one of CH bonds, $R^1$ and $R^2$ are the same or different, and each represents a fluorine atom or a —$C_vF_{2v+1}$ group, wherein v is an integer of 1 to 4; a is 0 or 1; b is an integer of 2 to 5; and c is 0 or 1, $R^3$ and $R^4$ each represents a fluorine atom or a —$CF_3$ group; a is the same as in formula 1c; d is 0 or 1; k is an integer of 0 to 5; 1 is an integer of 0 to 4; and m is 0 or 1, wherein (k+1+m) is an integer of 1 to 6, Formula 2

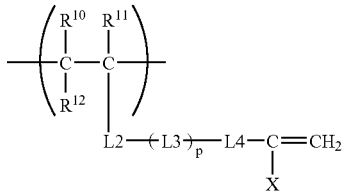

wherein, $R^{10}$ and $R^{11}$ each independently represents a hydrogen atom, a chlorine atom, or a fluorine atom; $R^{12}$ represents a hydrogen atom, a chlorine atom, a fluorine atom, an alkyl group, or a carboxyl group; L3 represents a connecting group having 1 to 20 carbon atoms; L2 and L4 each independently has the same meaning as L1 in formula 1b; p is 0 or 1; and X represents a hydrogen atom, a fluorine atom, a methyl group, or a cyano group, wherein the fluorine-containing polymerizable polymer comprises: a first segment which is a polymer chain comprising the first structural unit having the fluorine atom; and a second segment which is a polymer chain comprising the second structural unit having the radical-polymerizable group, wherein the fluorine-containing polymerizable polymer is one of: a linear polymer comprising the first segment and the second segment; and a branched polymer comprising the first segment and the second segment, wherein the nozzle has an underlying surface coated by the polymerizable composition, wherein the underlying surface has a surface irregularity based on JIS B0601-1994 such that:

an arithmetical mean roughness (Ra) is not more than 0.5 μm;

a ratio (Ra/Rz) of the arithmetical mean roughness (Ra) to a ten-point mean roughness (Rz) is 0.1 or more;

a maximum height (Ry) is not more than 0.5 μm; and a mean space of the surface irregularity (Sm) is from 0.005 to 1 μm.

2. A process for producing an inkjet recording head, which comprises a nozzle having: a hole for discharging a recording liquid including an ink; and a portion capable of repelling the ink at the periphery of the hole, the process comprising:

applying a polymerizable composition, wherein the polymerizable composition comprises: a solvent; and a fluorine-containing polymerizable polymer, and the fluorine-containing polymerizable polymer comprises: a first structural unit having a fluorine atom; and a second unit having a radical-polymerizable group;

vaporizing the solvent to form a film; and irradiating the film with an actinic energy ray to form a crosslinked resin, so as to produce the portion capable of repelling the ink, wherein the first structural unit having the fluorine atom is a structural unit represented by one of formulae 1a, 1b, 1c and 1d; and the second structural unit having the radical-polymerizable group is a structural unit represented by formula 2:

1a

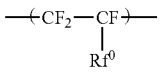

1b

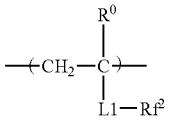

1c

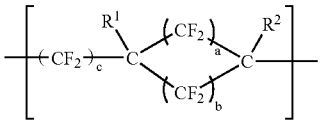

1d

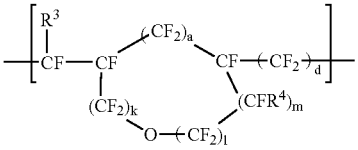

wherein $Rf^0$ represents a fluorine atom, a perfluoroalkyl group having 1 to 8 carbon atoms, or an —$ORf^1$ group, wherein $Rf^1$ represents a fluorine-containing aliphatic group having 1 to 30 constituent carbon atoms, $R^0$ represents a hydrogen atom, a fluorine atom, a methyl group, or a cyano group; L1 represents a covalent bond, —O—, —S—, —CO—, —COO—, —$CONR^{50}$—, —OCO—, —$OCONR^{51}$—, —$NR^{52}CO$—, —$NR^{53}COO$—, —$NR^{54}CONR^{55}$—, —SO—, —$SO_2$—, —$SO_2NR^{56}$—, —$NR^{57}SO_2$—, —$SiR^{58}R^{59}$—, —$PR^{60}$—, —$PO(OR^{61})$ O—, —$OPO(OR^{62})$—, —$PO(OR^{63})NR^{64}$—, —$NR^{65}PO(OR^{66})$—, —$NR^{67}PO(NR^{68}R^{69})NR^{70}$—, or —$NR^{71}$—, wherein $R^{50}$ to $R^{71}$ each represents a hydrogen atom, a substituted alkyl group or an unsubstituted alkyl group; and $Rf^2$ represents a hydrocarbon group in which a hydrogen atom is replaced with a fluorine atom in at least one of CH bonds, $R^1$ and $R^2$ are the same or different, and each represents a fluorine atom or a —$C_vF2_{v+1}$ group, wherein v is an integer of 1 to 4; a is 0 or 1; b is an integer of 2 to 5; and c is 0 or 1, $R^3$ and $R^4$ each represents a fluorine atom or a —$CF_3$ group; a is the same as in formula 1c; d is 0 or 1; k is an integer of 0 to 5; 1 is an integer of 0 to 4; and m is 0 or 1, wherein (k+1+m) is an integer of 1 to 6, Formula 2

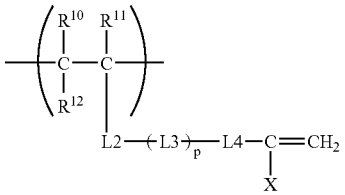

wherein, $R^{10}$ and $R^{11}$ each independently represents a hydrogen atom, a chlorine atom, or a fluorine atom; $R^{12}$ represents a hydrogen atom, a chlorine atom, a fluorine atom, a alkyl group, or a carboxyl group; L3 represents a connecting group having 1 to 20 carbon atoms; L2 and L4 each independently has the same meaning as L1 in formula 1b; p is 0 or 1; and X represents a hydrogen atom, a fluorine atom, a methyl group, or a cyano group.

wherein the nozzle has an underlying surface coated by the polymerizable composition, wherein the underlying surface has a surface irregularity based on JIS B0601-1994 such that:

an arithmetical mean roughness (Ra) is not more than 0.5 μm;

a ratio (Ra/Rz) of the arithmetical mean roughness (Ra) to a ten-point mean roughness (Rz) is 0.1 or more;

a maximum height (Ry) is not more than 0.5 μm; and a mean space of the surface irregularity (Sm) is from 0.005 to 1 μm.

3. The process according to claim 2, wherein the fluorine-containing polymerizable polymer comprises: a first segment which is a polymer chain comprising the first structural unit having the fluorine atom; and a second segment which is a polymer chain comprising the second structural unit having the radical-polymerizable group.

4. The process according to claim 3, wherein the fluorine-containing polymerizable polymer is one of: a linear polymer comprising the first segment and the second segment; and a branched polymer comprising the first segment and the second segment.

5. The process according to claim 4, wherein the portion capable of repelling the ink satisfies a condition that after the portion has a saturated charge amount by applying to an electrostatic field, the period that the portion gets to have a half amount of the saturated charge amount is not longer than 60 seconds.

6. The process according to claim 4, wherein the portion capable of repelling the ink is on an outer surface of the nozzle.

7. The process according to claim 2, wherein the actinic energy ray is ultraviolet light or visible light.

8. The process according to claim 2, wherein the actinic energy ray is visible light.

* * * * *